US012378057B2

(12) United States Patent
Moghaddas et al.

(10) Patent No.: US 12,378,057 B2
(45) Date of Patent: Aug. 5, 2025

(54) SHIPPING SYSTEM FOR STORING AND/OR TRANSPORTING TEMPERATURE-SENSITIVE MATERIALS

(71) Applicant: Cold Chain Technologies, LLC, Franklin, MA (US)

(72) Inventors: Ali Moghaddas, Cumberland, RI (US); Brian Paul Skocypec, North Attleboro, MA (US); Joseph Francis Consiglio, Ashland, MA (US); Kristin Pauline Deltano, Mansfield, MA (US); Stephanie J. Pazniokas, Franklin, MA (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 791 days.

(21) Appl. No.: 17/366,944

(22) Filed: Jul. 2, 2021

(65) Prior Publication Data

US 2022/0002070 A1 Jan. 6, 2022

Related U.S. Application Data

(60) Provisional application No. 63/047,835, filed on Jul. 2, 2020.

(51) Int. Cl.
*B65D 81/38* (2006.01)
*F25D 3/14* (2006.01)

(52) U.S. Cl.
CPC ..... *B65D 81/3823* (2013.01); *F25D 3/14* (2013.01); *F25D 2303/0843* (2013.01); *F25D 2303/085* (2013.01)

(58) Field of Classification Search
CPC ..... F25D 2303/085; F25D 2303/0843; F25D 3/14; F25D 2201/12; F25D 2323/061;
(Continued)

(56) References Cited

U.S. PATENT DOCUMENTS 1,691,178 A * 11/1928 Beaman ..... B65D 81/3858 229/103.11
1,843,038 A 1/1932 McIlvain
(Continued)

FOREIGN PATENT DOCUMENTS

CN 100455956 C 1/2009
CN 101811601 A 8/2010
(Continued)

OTHER PUBLICATIONS

U.S. Appl. No. 16/246,435, inventors James Robert Chasteen et al., filed Jan. 11, 2019.
(Continued)

*Primary Examiner* — Ernesto A Grano
(74) *Attorney, Agent, or Firm* — KRIEGSMAN & KRIEGSMAN

(57) ABSTRACT

Shipping system for storing and/or transporting temperature-sensitive materials. In one embodiment, the system includes an outer box having four side walls, bottom closure flaps, and top closure flaps. A vacuum insulated panel (VIP) is detachably coupled to one of the top closure flaps and is removably covered by a cover. An insulation unit is removably positioned within the outer box, the insulation unit including a plurality of VIPs arranged to define a cavity bounded by a bottom wall and four side walls. A disposable liner assembly is removably mounted on the insulation unit. The liner assembly includes a first liner piece, a second liner piece, and a liner support. A plurality of temperature-control members and a product box may be removably positioned in a cavity defined by the liner assembly. The temperature-control members snugly fit around all sides of the product box and each include a container containing dry ice.

28 Claims, 29 Drawing Sheets

(58) Field of Classification Search
CPC ..... F25D 5/02; F25D 23/069; F25D 23/067; F25D 23/06; B65D 81/3888; B65D 81/2823
USPC ..... 220/592.2
See application file for complete search history.

(56) References Cited

U.S. PATENT DOCUMENTS 2,034,114 A 3/1936 Moody
2,317,005 A 4/1941 Wasserman
2,289,060 A 7/1942 Merkle
2,467,268 A 4/1949 Merkle
2,515,709 A 7/1950 Heard et al.
2,528,715 A 11/1950 Wagner
2,844,299 A 7/1958 Kessler et al.
3,365,092 A 1/1968 Blessing
3,810,367 A 5/1974 Peterson
3,828,960 A 8/1974 Walles
3,890,762 A 6/1975 Emst et al.
3,980,005 A 9/1976 Buonaiuto
3,993,811 A 11/1976 Walles
4,134,276 A 1/1979 Lampard
4,145,895 A 3/1979 Hjertstrand et al.
4,206,616 A 6/1980 Frank et al.
4,292,817 A 10/1981 Loucks
4,294,079 A 10/1981 Benson
4,311,022 A 1/1982 Hall
4,344,301 A 8/1982 Taylor
4,377,075 A 3/1983 Russo
4,446,705 A 5/1984 Loucks
4,498,312 A 2/1985 Schlosser
4,527,370 A 7/1985 Schuette
4,529,638 A 7/1985 Yamamoto et al.
4,576,017 A 3/1986 Combs et al.
4,614,091 A 9/1986 Frank et al.
4,682,708 A 7/1987 Pool
4,819,793 A 4/1989 Williard et al.
4,889,252 A 12/1989 Rockom et al.
4,903,493 A 2/1990 Van Iperen et al.
4,928,847 A 5/1990 Hollander et al.
4,931,333 A 6/1990 Henry
4,947,658 A 8/1990 Wheeler et al.
5,042,260 A 8/1991 George, Sr.
5,102,004 A 4/1992 Hollander et al.
5,111,957 A 5/1992 Hollander et al.
5,216,900 A 6/1993 Jones
5,218,923 A 6/1993 LaRosa
5,323,911 A 6/1994 Johnston et al.
5,450,977 A 9/1995 Moe
5,501,338 A 3/1996 Preston
5,570,588 A 11/1996 Lowe
5,586,438 A 12/1996 Fahy
5,598,713 A 2/1997 Bartilucci
5,669,233 A 9/1997 Cook et al.
5,671,611 A 9/1997 Quigley
5,709,307 A 1/1998 Rosado et al.
5,746,854 A * 5/1998 Romes ..... B32B 37/04 156/244.27
5,755,987 A 5/1998 Goldstein et al.
5,897,017 A 4/1999 Lantz
5,899,088 A 5/1999 Purdum
5,924,302 A 7/1999 Derifield
5,979,693 A 11/1999 Bane, III
6,041,958 A 3/2000 Tremelo
6,044,650 A 4/2000 Cook et al.
6,055,825 A 5/2000 Choy
6,070,427 A 6/2000 Fine et al.
6,106,449 A 8/2000 Wynne
6,116,042 A 9/2000 Purdum
6,131,376 A 10/2000 Grey et al.
6,168,040 B1 1/2001 Sautner et al.
6,189,330 B1 2/2001 Retallick et al.
6,191,057 B1 * 2/2001 Patel ..... B32B 27/12 428/68
6,192,703 B1 2/2001 Salyer et al.
6,209,343 B1 4/2001 Owen
6,233,965 B1 5/2001 Choy
6,244,458 B1 6/2001 Frysinger et al.
6,257,764 B1 7/2001 Lantz
6,295,830 B1 10/2001 Newman
6,325,281 B1 12/2001 Grogan
6,336,340 B1 1/2002 Laby
6,349,559 B1 2/2002 Hasanovic
6,427,475 B1 8/2002 DeFelice et al.
6,450,398 B1 9/2002 Muise et al.
6,482,332 B1 11/2002 Malach
6,490,880 B1 12/2002 Walsh
6,519,968 B1 2/2003 Konarski
6,557,370 B2 5/2003 Gano, III
6,564,992 B1 5/2003 Wegner
6,574,983 B2 6/2003 Smith et al.
6,584,797 B1 7/2003 Smith et al.
6,619,500 B1 9/2003 Lantz
6,645,598 B2 11/2003 Alderman
6,668,577 B2 12/2003 Quenedey
6,718,776 B2 4/2004 Wessling et al.
6,755,568 B2 6/2004 Malone et al.
6,771,183 B2 8/2004 Hunter
6,838,146 B2 1/2005 Merrill et al.
6,868,982 B2 3/2005 Gordon
6,875,486 B2 4/2005 Miller
6,910,582 B2 6/2005 Lantz
7,028,504 B2 4/2006 Derifield
7,057,527 B2 6/2006 Hunter
7,131,289 B2 11/2006 Harl et al.
7,140,768 B2 11/2006 Prabhakar
7,147,626 B2 12/2006 Goodman et al.
7,225,632 B2 6/2007 Derifield
7,240,513 B1 7/2007 Conforti
7,257,963 B2 8/2007 Mayer
7,282,252 B2 * 10/2007 Fay ..... E04B 1/767 428/68
7,294,374 B2 11/2007 Romero
7,318,535 B2 1/2008 Gano, III et al.
7,328,583 B2 2/2008 Hillman et al.
7,422,143 B2 9/2008 Mayer
7,500,593 B2 3/2009 Mayer
7,537,817 B2 5/2009 Tsunetsugu et al.
7,607,540 B2 10/2009 Ballard
7,624,873 B2 12/2009 Tennant et al.
7,624,911 B2 12/2009 Spurrell et al.
7,641,812 B2 1/2010 Alderman
7,677,406 B2 3/2010 Maxson
7,681,405 B2 3/2010 Williams
7,704,584 B2 4/2010 Alderman
7,721,566 B1 5/2010 Wilken
7,849,708 B2 12/2010 Goncharko et al.
7,862,876 B2 1/2011 Yuasa et al.
7,896,182 B1 3/2011 Hansen et al.
7,908,870 B2 3/2011 Williams et al.
7,909,806 B2 3/2011 Goodman et al.
7,950,246 B1 5/2011 Mayer et al.
8,056,357 B2 11/2011 Bruce
8,074,465 B2 12/2011 Heroux et al.
8,152,367 B2 4/2012 Roberts et al.
8,156,703 B2 4/2012 Alderman
8,176,749 B2 5/2012 LaMere et al.
8,199,019 B2 6/2012 Kaczmarz et al.
8,202,599 B2 6/2012 Henn
8,250,882 B2 8/2012 Mustafa et al.
8,292,119 B2 10/2012 Kenneally
8,313,818 B2 11/2012 Vo et al.
8,333,279 B2 12/2012 Veiseh
8,342,588 B2 1/2013 Skaradzinski
8,349,552 B2 1/2013 Haarmann et al.
8,375,730 B2 2/2013 Haarmann et al.
8,424,317 B2 4/2013 Dain et al.
8,424,335 B2 4/2013 Corder et al.
8,567,211 B2 10/2013 Al-Rasheed
8,607,581 B2 12/2013 Williams et al.
8,613,202 B2 12/2013 Williams
8,763,423 B2 7/2014 Tattam
8,763,811 B2 * 7/2014 Lantz ..... B65D 65/466 206/584

(56) References Cited

U.S. PATENT DOCUMENTS 8,863,546 B2 10/2014 Oberweis
8,881,398 B2 11/2014 Han
8,881,540 B1 11/2014 Barakat et al.
8,887,515 B2 11/2014 Patstone
8,899,071 B2 12/2014 Mogil et al.
8,904,810 B2 12/2014 Schabron et al.
8,919,082 B1 12/2014 Cataldo
8,935,934 B2 1/2015 Barakat
8,938,986 B2 1/2015 Matta et al.
8,956,710 B2 2/2015 Jang et al.
9,022,249 B2 5/2015 Ranade
9,045,278 B2 6/2015 Mustafa
9,060,508 B2 6/2015 Anti et al.
9,139,319 B2 9/2015 Crespo et al.
9,151,531 B2 10/2015 Wengreen et al.
9,180,998 B2 11/2015 Banks et al.
9,272,475 B2 3/2016 Ranade et al.
9,366,469 B2 6/2016 Chapman, Jr.
9,373,099 B2 6/2016 Barakat
9,376,605 B2 6/2016 Matta et al.
9,400,966 B2 7/2016 Dertadian
9,429,350 B2 8/2016 Chapman, Jr.
9,513,067 B2 12/2016 Ahmed
9,550,618 B1 * 1/2017 Jobe ..... B65D 5/64
9,556,373 B2 1/2017 Formato et al.
9,598,622 B2 3/2017 Formato et al.
9,611,067 B2 4/2017 Collison
9,688,454 B2 6/2017 Ranade
9,689,602 B2 6/2017 Emond et al.
9,707,156 B2 7/2017 Wengreen et al.
9,719,688 B2 8/2017 Holloway et al.
9,751,682 B2 9/2017 Mayer et al.
9,814,651 B2 11/2017 Wengreen et al.
9,828,137 B2 11/2017 Albert et al.
9,828,165 B2 11/2017 Ranade et al.
9,834,365 B2 12/2017 Pointer et al.
9,877,894 B2 1/2018 Wengreen et al.
9,909,797 B2 3/2018 Van Wuffen
9,913,777 B2 3/2018 Wengreen et al.
9,926,102 B2 3/2018 Baker
9,944,449 B2 4/2018 Wood et al.
9,950,851 B2 4/2018 Ranade
9,956,140 B2 5/2018 Wengreen et al.
9,957,098 B2 5/2018 Jobe
9,957,099 B2 5/2018 White et al.
9,963,287 B2 5/2018 Aksan et al.
9,975,686 B2 5/2018 Caps
9,981,797 B2 * 5/2018 Aksan ..... B65D 81/3816
9,994,385 B2 6/2018 Dudi et al.
10,046,901 B1 8/2018 Jobe
10,077,389 B2 9/2018 Formato et al.
10,104,876 B2 10/2018 Garland et al.
10,119,741 B2 11/2018 Jackson et al.
10,253,918 B2 4/2019 McCormick
10,266,332 B2 * 4/2019 Aksan ..... B65D 81/3862
10,273,073 B2 4/2019 Collison
10,274,247 B2 4/2019 Jeong et al.
10,279,991 B2 5/2019 Roger et al.
10,309,709 B2 6/2019 Emond et al.
10,329,074 B2 6/2019 Ranade et al.
10,443,918 B2 10/2019 Li et al.
10,457,469 B2 10/2019 Tumber et al.
10,501,254 B2 12/2019 Wood et al.
10,508,854 B2 12/2019 Demuth et al.
10,568,808 B2 2/2020 Ferracamo, Jr.
10,583,978 B2 3/2020 Longley et al.
10,604,326 B2 3/2020 Longley et al.
10,610,985 B2 4/2020 Liu et al.
10,618,695 B2 4/2020 McCormick
10,647,498 B1 5/2020 Brygier, III
10,661,969 B2 5/2020 Pranadi et al.
10,669,466 B2 6/2020 Miyashita
10,766,685 B2 9/2020 Kuhn et al.
10,767,915 B2 9/2020 Wickline
10,829,675 B2 11/2020 Formato et al.
10,899,529 B2 1/2021 MokhtarzadehBahadorani
10,928,115 B2 2/2021 Ansted et al.
10,941,977 B2 3/2021 Waltermire et al.
10,946,562 B2 3/2021 Mohmeyer et al.
10,962,270 B2 3/2021 Jain et al.
10,968,625 B2 4/2021 Mack et al.
11,040,818 B2 6/2021 Jobe
11,085,688 B2 8/2021 Seo et al.
11,137,190 B2 10/2021 Martino
11,287,079 B2 3/2022 Biswas et al.
11,340,005 B2 5/2022 Nilsen et al.
11,446,915 B2 9/2022 Biswas et al.
11,472,625 B2 10/2022 Mirzaee Kakhki
11,499,770 B2 11/2022 Rizzo et al.
11,511,928 B2 11/2022 Rizzo et al.
11,518,602 B2 12/2022 Knight
11,535,443 B2 12/2022 Caps
11,634,264 B2 4/2023 Caps
11,634,266 B2 4/2023 Kulangara et al.
11,649,639 B2 5/2023 Olvey et al.
11,731,826 B2 * 8/2023 Blezard ..... B65D 81/3823 229/103.11
11,820,579 B1 * 11/2023 Lantz ..... B65D 81/3823
11,953,262 B2 * 4/2024 Blezard ..... B65D 21/0202
2002/0134962 A1 9/2002 Romero
2002/0144482 A1 10/2002 Henson et al.
2003/0102317 A1 * 6/2003 Gordon ..... B65D 81/3823 220/592.2
2004/0131871 A1 7/2004 Lee et al.
2004/0151851 A1 8/2004 Miller
2005/0098255 A1 5/2005 Lembo et al.
2005/0178142 A1 8/2005 Perry et al.
2005/0189404 A1 9/2005 Xiaohai et al.
2005/0224501 A1 10/2005 Folkert et al.
2006/0053828 A1 3/2006 Shallman et al.
2006/0175227 A1 8/2006 Lau
2006/0218963 A1 10/2006 Elias
2006/0240216 A1 10/2006 Stepanian et al.
2007/0028642 A1 2/2007 Glade et al.
2007/0051734 A1 3/2007 Kuhn
2007/0051782 A1 3/2007 Lantz
2007/0084232 A1 4/2007 Whewell, Jr.
2007/0186577 A1 8/2007 Goncharko
2007/0193297 A1 8/2007 Wilson
2007/0193298 A1 8/2007 Derifield
2008/0006628 A1 1/2008 Goncharko et al.
2008/0135564 A1 6/2008 Romero
2008/0164265 A1 7/2008 Conforti
2008/0223066 A1 9/2008 Henderson et al.
2008/0292220 A1 11/2008 Zacchi
2009/0001086 A1 1/2009 Roderick et al.
2009/0078708 A1 3/2009 Williams
2009/0179541 A1 7/2009 Smith et al.
2009/0230138 A1 9/2009 Williams et al.
2009/0230139 A1 9/2009 Li
2010/0012653 A1 1/2010 Ulrich et al.
2010/0038369 A1 2/2010 CaNas et al.
2010/0062519 A1 3/2010 Franklin, Jr. et al.
2010/0072211 A1 3/2010 Dickinson et al.
2010/0162734 A1 7/2010 McCormick et al.
2010/0289669 A1 11/2010 Saltzman et al.
2010/0299278 A1 11/2010 Kriss et al.
2010/0314397 A1 12/2010 Williams et al.
2010/0326993 A1 12/2010 Mayer
2011/0079330 A1 4/2011 Raine et al.
2011/0248038 A1 10/2011 Mayer
2011/0253289 A1 10/2011 Shepard
2011/0290792 A1 12/2011 Krzak et al.
2012/0009376 A1 1/2012 Rusek, Jr.
2012/0237716 A1 9/2012 Fukuzawa et al.
2012/0248101 A1 10/2012 Tumber et al.
2013/0020309 A1 1/2013 Tattam et al.
2013/0055750 A1 3/2013 Mustafa
2013/0062355 A1 3/2013 Shulman
2013/0213977 A1 8/2013 Stathes et al.
2013/0228583 A1 9/2013 Mayer
2013/0245991 A1 9/2013 Kriss
2013/0255306 A1 10/2013 Mayer
2014/0008042 A1 1/2014 Schryver et al.

(56) References Cited

U.S. PATENT DOCUMENTS

2014/0054297 A1 2/2014 Patstone
2014/0059978 A1 3/2014 Bolejack et al.
2014/0091098 A1 4/2014 Casoli
2014/0138392 A1 5/2014 McCormick
2014/0144161 A1 5/2014 Pointer et al.
2014/0151382 A1* 6/2014 White ..... F25D 3/08 220/592.2
2014/0157797 A1 6/2014 Kovalick et al.
2014/0311170 A1 10/2014 Mills et al.
2014/0319018 A1 10/2014 Collison
2014/0331711 A1 11/2014 Blezard et al.
2014/0343493 A1 11/2014 Wengreen
2015/0068242 A1 3/2015 Patstone
2015/0090728 A1 4/2015 Lubart et al.
2015/0150244 A9 6/2015 Annis et al.
2015/0166244 A1 6/2015 Wood et al.
2015/0191291 A1 7/2015 Wood et al.
2015/0217927 A1 8/2015 Ranade
2015/0239639 A1 8/2015 Wenner et al.
2015/0251758 A1 9/2015 Vandyke et al.
2015/0259126 A1 9/2015 McGoff et al.
2015/0274415 A1 10/2015 Farrar et al.
2015/0276297 A1 10/2015 Moore et al.
2016/0039594 A1 2/2016 Ranade
2016/0075498 A1 3/2016 Mayer et al.
2016/0123648 A1 5/2016 Leaverton
2016/0130066 A1 5/2016 Ranade et al.
2016/0161171 A1 6/2016 Blezard et al.
2016/0262979 A1 9/2016 Wengreen et al.
2016/0297606 A1 10/2016 Roger et al.
2016/0305598 A1 10/2016 Ranade
2016/0311600 A1 10/2016 Albert et al.
2016/0341711 A1 11/2016 Rice et al.
2016/0362240 A1 12/2016 Ferracamo, Jr.
2017/0001406 A1 1/2017 Graf et al.
2017/0001422 A1 1/2017 Bauernfeind
2017/0001785 A1 1/2017 Ripley et al.
2017/0010037 A1 1/2017 Allard et al.
2017/0015488 A1 1/2017 Caps
2017/0072604 A1 3/2017 Sjong
2017/0073146 A1 3/2017 Kuhn et al.
2017/0073147 A1 3/2017 Kuhn
2017/0082344 A1 3/2017 Tansley
2017/0113868 A1 4/2017 Ahmed et al.
2017/0121097 A1 5/2017 Pranadi et al.
2017/0131015 A1 5/2017 Farrar
2017/0146276 A1 5/2017 Newman
2017/0158411 A1 6/2017 Taka et al.
2017/0198959 A1 7/2017 Morris
2017/0225869 A1 8/2017 Ranade
2017/0240337 A1 8/2017 Austerberry et al.
2017/0245486 A1 8/2017 Larson et al.
2017/0284723 A1 10/2017 Newman
2017/0305632 A1 10/2017 Brown
2017/0305639 A1 10/2017 Kuhn et al.
2017/0350635 A1 12/2017 Thirumurugavel
2018/0036202 A1 2/2018 Wengreen et al.
2018/0086534 A1 3/2018 Kilmer et al.
2018/0093816 A1 4/2018 Longley et al.
2018/0100682 A1 4/2018 Nilsen et al.
2018/0134427 A1 5/2018 Fallgren
2018/0148245 A1 5/2018 Aggarwal et al.
2018/0194535 A1 7/2018 Collison
2018/0202700 A1 7/2018 Anstead et al.
2018/0237207 A1 8/2018 Aksan et al.
2018/0282049 A1 10/2018 Tumber et al.
2018/0320947 A1 11/2018 Jain et al.
2018/0328644 A1 11/2018 Rizzo et al.
2018/0339838 A1* 11/2018 Hall ..... B65B 55/20
2018/0353379 A1 12/2018 Chou et al.
2019/0210790 A1 7/2019 Rizzo et al.
2019/0219320 A1 7/2019 Wood et al.
2019/0226744 A1 7/2019 Wood et al.
2019/0241350 A1 8/2019 Goellner
2019/0248573 A1 8/2019 Collison et al.
2019/0316345 A1 10/2019 Caps et al.
2019/0359407 A1 11/2019 Kale et al.
2019/0367208 A1* 12/2019 Jobe ..... B65D 65/466
2020/0002075 A1 1/2020 Lee et al.
2020/0047993 A1 2/2020 Brabbs et al.
2020/0087052 A1 3/2020 Lyons
2020/0122909 A1 4/2020 Jobe
2020/0141531 A1 5/2020 Rell et al.
2020/0156852 A1 5/2020 Veiseh
2020/0189830 A1 6/2020 Tumber et al.
2020/0206082 A1 7/2020 Ferracamo, Jr.
2020/0231362 A1 7/2020 Kulangara et al.
2020/0307896 A1 10/2020 Pranadi et al.
2020/0324959 A1 10/2020 Longley et al.
2020/0331686 A1 10/2020 Longley et al.
2020/0346840 A1 11/2020 Munie et al.
2020/0378544 A1 12/2020 Bock et al.
2020/0378676 A1 12/2020 Rowe et al.
2020/0408453 A1 12/2020 Martino
2021/0016955 A1 1/2021 Morine et al.
2021/0024270 A1 1/2021 Mirzaee Kakhki
2021/0039869 A1* 2/2021 Waltermire ..... B65D 81/386
2021/0070539 A1 3/2021 Chasteen et al.
2021/0102746 A1 4/2021 Waltermire et al.
2021/0253292 A1 8/2021 Reyes
2021/0253330 A1* 8/2021 Madanagopal ..... B65D 5/566
2021/0254877 A1* 8/2021 Massenzo ..... F25D 3/06
2021/0300665 A1 9/2021 Melchor
2021/0301970 A1 9/2021 Yamashita et al.
2021/0309442 A1 10/2021 Kletzel et al.
2022/0194682 A1 6/2022 Michel et al.
2022/0265514 A1 8/2022 Blezard et al.
2022/0267081 A1 8/2022 Conway et al.
2022/0267657 A1 8/2022 Blezard et al.
2022/0281671 A1 9/2022 Lee et al.
2022/0333840 A1 10/2022 Chasteen et al.
2022/0343270 A1 10/2022 Melchor et al.
2022/0352593 A1 10/2022 Nilsen et al.
2022/0388756 A1 12/2022 Birgersen et al.
2022/0388757 A1 12/2022 Rizzo et al.
2023/0064825 A1 3/2023 Conway et al.
2023/0131560 A1 4/2023 Blezard et al.
2023/0173785 A1 6/2023 Kuhn et al.
2023/0202141 A1 6/2023 Bock et al.
2023/0227236 A1 7/2023 Nilsen et al.
2023/0249896 A1 8/2023 Blezard
2023/0251011 A1 8/2023 Blezard et al.
2023/0312219 A1 10/2023 Robertson et al.

FOREIGN PATENT DOCUMENTS

CN 201980585 U 5/2012
CN 202244410 U 2/2013
CN 202831270 U 3/2013
CN 202945694 U 5/2013
CN 202728724 U 5/2014
CN 203601782 U 5/2014
CN 103964076 A 8/2014
CN 204822615 U 12/2015
CN 205312237 U 6/2016
CN 106081351 A 11/2016
CN 103672303 B 1/2017
CN 207644932 U 7/2018
CN 105971183 B 12/2018
CN 108943947 B 12/2018
CN 209410800 U 9/2019
CN 110513569 A 11/2019
CN 110549701 A 12/2019
CN 210479596 U 5/2020
CN 109185603 B 8/2020
CN 211944580 U 11/2020
CN 211951909 U 11/2020
CN 114834112 A 8/2022
CN 115012544 A 9/2022
CN 116061527 A 5/2023
CN 116065714 A 5/2023
CN 114321570 B 8/2023
CN 107804573 B 11/2023
DE 1486302 B1 9/1970

(56) References Cited

FOREIGN PATENT DOCUMENTS

| | | | |
|---|---|---|---|
| DE | 10107478 | A1 | 9/2002 |
| DE | 10123453 | A1 | 11/2002 |
| DE | 10131136 | A1 | 1/2003 |
| DE | 10336835 | A1 | 3/2005 |
| DE | 202007012289 | U1 | 11/2007 |
| DE | 102007059799 | A1 | 6/2008 |
| DE | 102008036669 | A1 | 2/2010 |
| DE | 102014003413 | A1 | 9/2015 |
| DE | 202015004047 | U1 | 10/2016 |
| DE | 202017003908 | U1 | 9/2017 |
| DE | 102017119920 | A1 | 12/2018 |
| DE | 202019001700 | U1 | 9/2019 |
| DE | 202022101226 | U1 | 4/2022 |
| EP | 0940352 | A2 | 9/1999 |
| EP | 1006058 | A1 | 6/2000 |
| EP | 1177984 | A2 | 2/2002 |
| EP | 1336574 | A2 | 8/2003 |
| EP | 1887154 | A2 | 2/2008 |
| EP | 2050884 | A2 | 4/2009 |
| EP | 1500752 | B1 | 10/2010 |
| EP | 1898014 | B1 | 1/2013 |
| EP | 2700891 | A2 | 2/2014 |
| EP | 2081838 | B1 | 8/2014 |
| EP | 2179648 | B1 | 12/2014 |
| EP | 2883811 | A1 | 6/2015 |
| EP | 2883812 | A1 | 1/2018 |
| EP | 3112289 | B1 | 12/2018 |
| EP | 3090961 | B1 | 2/2019 |
| EP | 3270709 | B1 | 5/2019 |
| EP | 3421860 | B1 | 6/2020 |
| EP | 3601095 | B1 | 4/2021 |
| EP | 3808684 | A1 | 4/2021 |
| EP | 4230596 | A1 | 8/2023 |
| FR | 2604981 | B1 | 6/1989 |
| FR | 2697809 | A1 | 5/1994 |
| FR | 2884810 | A1 | 10/2006 |
| FR | 2948342 | B1 | 9/2011 |
| FR | 2994420 | A1 | 2/2014 |
| GB | 2492195 | B | 6/2013 |
| GB | 2548887 | B | 3/2019 |
| GB | 2566792 | A | 3/2019 |
| JP | 06298283 | A | 10/1994 |
| JP | 2000211667 | A | 8/2000 |
| JP | 2006306422 | A | 11/2006 |
| JP | 2007191195 | A | 8/2007 |
| JP | 2007253974 | A | 10/2007 |
| JP | 2008068871 | A | 3/2008 |
| JP | 2009113822 | A | 5/2009 |
| JP | 2010089802 | A | 4/2010 |
| JP | 2010208644 | A | 9/2010 |
| JP | 2013010524 | A | 1/2013 |
| JP | 5435435 | B2 | 3/2014 |
| KR | 20030060191 | A1 | 7/2003 |
| KR | 101457029 | B1 | 11/2014 |
| WO | 9747174 | A1 | 12/1997 |
| WO | 1997045326 | A1 | 12/1997 |
| WO | 9916330 | A1 | 4/1999 |
| WO | 9932374 | A1 | 7/1999 |
| WO | 0060184 | A1 | 10/2000 |
| WO | 0144731 | A1 | 6/2001 |
| WO | 2006082433 | A1 | 8/2006 |
| WO | 2007030110 | A1 | 3/2007 |
| WO | 2008133374 | A1 | 11/2008 |
| WO | 2010044107 | A2 | 4/2010 |
| WO | 2011152610 | A1 | 12/2011 |
| WO | 2012017910 | A1 | 2/2012 |
| WO | 2013014409 | A1 | 1/2013 |
| WO | 2013144621 | A2 | 10/2013 |
| WO | 2014007444 | A1 | 1/2014 |
| WO | 2014067927 | A1 | 5/2014 |
| WO | 2014118821 | A1 | 8/2014 |
| WO | 2014125878 | A1 | 8/2014 |
| WO | 2014147425 | A2 | 9/2014 |
| WO | 2014163274 | A1 | 10/2014 |
| WO | 2014183019 | A1 | 11/2014 |
| WO | 2015117568 | A1 | 8/2015 |
| WO | 2016033077 | A1 | 3/2016 |
| WO | 2016120224 | A1 | 8/2016 |
| WO | 2016149627 | A1 | 9/2016 |
| WO | 2016168523 | A1 | 10/2016 |
| WO | 2016208193 | A1 | 12/2016 |
| WO | 2017048793 | A1 | 3/2017 |
| WO | 2017062692 | A1 | 4/2017 |
| WO | 2017072638 | A1 | 5/2017 |
| WO | 2017220953 | A1 | 12/2017 |
| WO | 2017220954 | A1 | 12/2017 |
| WO | 2018075470 | A1 | 4/2018 |
| WO | 2018197049 | A1 | 11/2018 |
| WO | 2018208986 | A1 | 11/2018 |
| WO | 2018213348 | A2 | 11/2018 |
| WO | 2019011478 | A1 | 1/2019 |
| WO | 2019059585 | A1 | 3/2019 |
| WO | 2019091581 | A1 | 5/2019 |
| WO | 2020097477 | A1 | 5/2020 |
| WO | 2020157488 | A1 | 8/2020 |
| WO | 2020193872 | A1 | 10/2020 |

OTHER PUBLICATIONS

"The Quantum Plus+ Systems," https://radmat.com/protherm-quantum/the-quantum-systems/; accessed Feb. 21, 2024.

"Self-Healing Films for Vacuum Insulation Panels" (Mar. 23, 2021), https://www.energy.gov/eere/buildings/articles/self-healing-films-vacuum-insulation-panels; accessed Feb. 21, 2024.

"Demonstration of self-healing barrier films for vacuum insulation panels," Vacuum, 164:132-139 (Jun. 2019), https://www.sciencedirect.com/science/article/abs/pii/S0042207X1832147X?via%3Dihub; accessed Feb. 21, 2024.

"Self-Healing Films to Improve Durability of VIPs by In-Situ Remediation of Film Defects" (May 22, 2019), https://www.energy.gov/eere/buildings/articles/self-healing-films-improve-durability-vips-situ-remediation-film-defects; accessed Feb. 21, 2024.

"Kaushik Biswas: Making self-healing building materials a reality" (Jun. 6, 2018), https://www.ornl.gov/news/kaushik-biswas-making-self-healing-building-materials-reality; accessed Feb. 21, 2024.

Peng et al. "Structure, Mechanism, and Application of Vacuum Insulation Panels in Chinese Buildings," Advances in Building Technologies and Construction Materials 2016 (May 19, 2016), https://www.hindawi.com/journals/amse/2016/1358072/; accessed Feb. 21, 2024.

"Raising inverted roof performance with encapsulated vacuum insulation panels," pbctoday (Aug. 14, 2023), https://www.pbctoday.co.uk/news/energy-news/raising-inverted-roof-performance-with-vips/131169/; accessed Feb. 21, 2024.

"Vacuum Insulation Panels (VIP) Shippers," https://www.thermosafe.com/products/insulated-shippers/life-sciences-healthcare/vip-shippers/; accessed Feb. 21, 2024.

Frattaruolo, "Reducing temperature excursions in cold chain shipping—The business imperative for using phase-change materials (PCM)," (May 18, 2021), https://csafeglobal.com/blog/2021/05/18/reduce-temperature-excursions-using-vip-and-phase-change-material/; accessed Feb. 21, 2024.

"Reusable Passive Thermal Parcel Shippers," Pelican Biothermal®, pelicanbiothermal.com, Nov. 6, 2016. https://web.archive.org/web/20161106221805/http://pelicanbiothermal.com/therma••packaging/reusable•parce.

"IBOX," So Fri Gam, sofrigam.com, 201••0••04. https://web.archive.org/web/20170304003303/http://www.sofrigam.com/iBox•col••chain•packaging.

"VIP Series," Panasonic, panasonic.healthcare.com, MD••U76VC•PA | MD••U76VA•PA, Dec. 2, 2016. http://www.panasonic.healthcare.com/us/~/media/biomedical/americas/us/catalogs/Cut%20Sheets/PHCNA_MDF76_product_sheet.pdf.

"V••••Tcon3," VA•••Tec, va•q•tec.com, accessed: May 2017. http://www.v••q•tec.com/en/products•industries/healthcar••logistics/cold•chai••packaging/clinical•trials/v••••tcon.html.

"Vacuum Insulated Panel (VIP) Shippers," Sonoco Thermosafe®, thermosafe.com, Oct. 6, 2016. https://web.archive.org/web/20161006061833/http://www.thermosafe.com:80/insulatedshippers.

(56) References Cited

OTHER PUBLICATIONS https://chill-pak.com/collapsible-insulated-shipping-coolers/ (2020).
https://ipcpack.com/products/green-liner/ (2020).
https://www.cryopak.com/packaging-and-refrigerants/insulated-shipping-containers/vip/ (2016).
https://therapak.com/catalog/insulated-shippers/ (2020).
https://www.sealedair.com/products/protective-packaging/insulated-box-liners (2020).
https://www.thermosafe.com/insulatedshippers (2020).
https://www.achfoam.com/Packaging/DuraTherm-Shipping-Containers/DuraTherm-Shipper-Services.aspx (2020).
http://www.nanopore.com/shipping.html (2008).
Pack-out Sheet for HP-76-ST Shipping System, Cold Chain Technologies, Franklin, MA (2011).
Pack-out Sheet for Excel GTS-6L-RFG Shipping Systems, Cold Chain Technologies, Franklin, MA (2014).
Pack-out Sheet for KoolTemp GTS Extreme 7L Shipping System, Cold Chain Technologies, Franklin, MA (2014).
Pack-out Sheet for KoolTemp GTS Excel 26L Shipping System, Cold Chain Technologies, Franklin, MA (2013).
Pack-out Sheet for KoolTemp GTS Extreme 45L Shipping System, Cold Chain Technologies, Franklin, MA (2014).
Pack-out Sheet for KoolTemp HP-75 Shipping System, Cold Chain Technologies, Franklin, MA (2011).
Pack-out Sheet for JOM Small Shipper, Cold Chain Technologies, Franklin, MA (2017).
Pack-out Sheet for Sanofi GTS-3L CRT Shipping System, Cold Chain Technologies, Franklin, MA (2017).
Sales literature for AEON reusable shippers, Softbox Systems Limited, Buckinghamshire, UK (2021).
Sales literature for Chilltech shipping system, Sonoco Thermosafe, Arlington Heights, IL (2017).
Laminar Medica Company Presentation, Laminar Medica Limited, Hertfordshire, UK (2016).
ThermoSafe catalog, Sonoco ThermoSafe, Arlington Heights, IL (2014).
Sales literature for va-Q-proof shipping solution, va-Q-tec AG, Wuerzburg, Germany (2020).
Sales literature for Chronos Advance shipper, Pelican BioThermal, Maple Grove, MN (2018).
Sales literature for Credo Cube shipper, Pelican BioThermal, Maple Grove, MN (2018).
Almac White Paper, "Changing the Dynamics of Temperature Controlled Shipping Solutions," Almac Group, Craigavon, UK (2017).
Ashokan, "A Comparative Study for Cold Chain Packaging Options," Thesis for Master of Science, Rochester Institute of Technology (2011).
Caps et al., "Quality control of vacuum insulation panels: Methods of measuring gas pressure," Vacuum, 82: 691-699 (2008).
2018 photos taken by Applicant of Chilltech shipping system with Zero Bench-Time insert (white).
Saf-T-Pak catalog, Saf-T-Pak Inmark, Edmonton, Canada (2017).
Sonoco Thermosafe catalog, Sonoco ThermoSafe, Arlington Heights, IL (2017).
Sales literature for Vype shipping system, Emball'iso Group, Saint Georges de Reneins, France (2018).
"Evo DI dry ice smart shipper" biolifesolutions.com; https://www.biolifesolutions.com/cold-chain-management/evo-dry-ice-shippers/.
"Sherpa Systems Dry Ice" pelibiothermal.com Oct. 13, 2021; https://pelibiothermal.com/products/sherpa-systems-dry-ice.
"Ex-Temp Validated Boxes" marathonproducts.com Nov. 13, 2017; https://marathonproducts.com/product/ex-temp-shipping-boxes/#1483571719208-13f78a46-84e6.
"Evertemp Urethane Insulated Shipping Containers" coldice.com Feb. 17, 2015; https://www.coldice.com/insulated_shipping_containers/.
Pack-out Sheet for Novartis GTS-77 Shipping System, Cold Chain Technologies, Franklin, MA (2011).
Pack-out Sheet for GTS-77 Shipping System, Cold Chain Technologies, Franklin, MA (2010).
U.S. Appl. No. 18/628,646, inventors James R. Chasteen et al., filed Apr. 5, 2024.
"Thermosafe Multi-Purpose Dry Ice Mailers," thomassci.com. Accessed: Dec. 16, 2021. https://web.archive.org/web/20211216000810/https://www.thomassci.com/Laboratory-Supplies/Mailers/_/MULTI-PURPOSE-DRY-ICE-MAILERS?q=Dry+Ice+Container.
"Polar Tech," polar-tech.com. Accessed: Dec. 16, 2021. https://web.archive.org/web/20211216011453/https://www.polar-tech.com/wp-content/uploads/2019/10/Science_catalog.pdf.
"STS Frozen Parcel Family," coldchaintech.com. Apr. 15, 2016. https://web.archive.org/web/20160415191312/http://www.coldchaintech.com/product-details/sts/.
"Passive Packaging Solutions—Va-Q-tainer," fedex.com. Accessed: Dec. 16, 2021. https://web.archive.org/web/20211216005634/https://www.fedex.com/en-cn/shipping/industry-solutions/healthcare/temperature-control.html.
"Frozen Shippers GTS Extreme Family," coldchaintech.com. Jun. 12, 2016. https://web.archive.org/web/20160612102223/http://www.coldchaintech.com:80/product-details/gts-extreme.
"Dry ice storage containers," ddbiolab.com. Accessed: Dec. 16, 2021. https://web.archive.org/web/20211216002005/https://www.ddbiolab.com/frontoffice/product?produitId=0I-17-18.
"Cryoboxx," cryoboxx.com. Accessed: Dec. 16, 2021. https://web.archive.org/web/20211216002709/https://www.cryoboxx.com/en/cryoboxx/.
"Therapak EPS (Expanded Polystyrene) Insulated Shippers for Refrigerated andFrozen Specimen Shipment," therapak.com. Jul. 28, 2018. https://web.archive.org/web/20180728115104/https://therapak.com/catalog/insulated-shippers/.
"Initial International," sofrigam.com. Apr. 10, 2023. https://sofrigam.com/en/product/89-initial-international.
Mei et al., "Impact of Excessive Sublimation Cooling on the Internal Temperature of Passive Shippers Cooled by Dry Ice," PDA Journal of Pharmaceutical Science and Technology, 74(1):49-57 (2019).
Chern et al., "Root Cause for Near −90° C. Excursions in Passive Shippers with Dry Ice as the Coolant," Amgen, IQPC Chicago (2017).
Pack-out Sheet for CCT STS-U186-DIUL Shipping System, Cold Chain Technologies, Franklin, MA (2011).
"below-zero Complete without Orange bio-bottle," BB: bio-bottle, biobottle.com, SKU: BZOW1, 2018 https://www.bio-bottle.com/shop /below-zero/below-zero-complete-withoutorange-bio-bottle/.
"Cold Chain Logistics Accessories: Cryoport Exclusive Accessories Safepak®," Cryoport, cryoportj.com, 2018. https://www.cryoport.com/servi ces/cold-chain-logistics-accessories.
"Simport Cryostore™ Storage Boxes," Thomas Scientific, thomassci.com, 2018. https://www.thomassci.com/Laboratory-Supplies/Boxes/_/CRYOSTORE-Storage-Boxes?q=Cryovial%20Storage%20Boxes.
"Packaging Requirements for Dry Ice," Standard Operating Procedure, ehs.umich.edu, Rev.#2, Univ. of Michigan, Jun. 2, 2017. https://ehs.umich.edu/wp-content/uploads/2018/04/Pkg- Req-Dry-Ice.pdf.
Romeo, Ben, "Upgrading of Traditional Cold Chain Shipping Systems Using 2-8degree C Phase Change Materials," Pharmaceutical OutsourcingTM, pharmoutsourcing.com, Nov. 27, 2017. http://web.archive.org/web/20171127155311/http://www.pharmoutsourcing.com/Featured-Articles/37644-Upgrading-of-Traditional-Cold-Chain-Shipping-Systems-Using-2-8-C-Phase-Change-Materials/.
"SavENRG Temperature Controlled Container," SavENRG, rgees.com, Dec. 5, 2012. https://web.archive.org/web/20121205011328/http://rgees.com:80/solutions_refrigerated-shipping.php.
"Complete Cold-Chain Design, Implementation and Shipping Services," AeroSafe Global, aerosafeglobal.com, Oct. 16, 2018. https://web.archive.org/web/20181016010215/https://www.aerosafeglobal.com/complete-solution.
"Food Delivery & Supply Chains," Croda, crodatherm.com, Oct. 16, 2018. https://web.archive.org/web/20181016013357/https://www.crodatherm.com/en-gb/products-and-applications/food-and-refrigeration/food-delivery-and-supply-chains.

(56) References Cited

OTHER PUBLICATIONS

Singh, Suman, Kirtiraj. K. Gaikwad, and Youn Suk Lee, "Phase change materials for advanced cooling packaging," Environmental Chemistry Letters (2018): 1-15. https://www.researchgate.net/publication/324695298_Phase_change_materials_for_advanced_cooling_packaging.

"Global Thermal Container with Phase Change Materials," World Courier, https://www.youtube.com/watch?=Mwabx3W-ado (2017).

International Search Report mailed Oct. 13, 2021, in PCT Application No. PCT/US21/40360, the corresponding PCT application to the present application.

Written Opinion mailed Oct. 13, 2021, in PCT Application No. PCT/US21/40360, the corresponding PCT application to the present application.

"Collapsible Insulated Shipping Coolers: Reliable & Cost-Efficient"; https://chill-pak.com/collapsible-insulated-shipping-coolers/; accessed Jun. 3, 2023.

"IPC Full Product Selection"; https://ipcpack.com/products/; accessed Jun. 3, 2023.

"TemPak Fabricated Insulated Shipping Containers"; https://www.cryopak.com/cold-chain-packaging/insulated-containers/tempak-fabricated-insulated-shipping-containers/; accessed Jun. 3, 2023.

"Insulated Shippers: TheraPak Compact Insulated Shippers"; https://www.therapak.com/catalog/insulated-shippers/; accessed Jun. 3, 2023.

"Sealed Air: Tempguard"; https://www.sealedair.com/products/protective-packaging/insulated-box-liners#/tempguard-tab; accessed Jun. 3, 2023.

"Sonoco Thermosafe Vacuum Insulated Panel (VIP) Shippers"; https://www.thermosafe.com/products/insulated-shippers/life-sciences-healthcare/vip-shippers/; accessed Jun. 3, 2023.

"Nanopore: Insulated Shipping Containers"; http://www.nanopore.com/shipping.html; accessed Jun. 3, 2023.

"DuraTherm Cold Chain Packaging"; https://www.atlasmoldedproducts.com/packaging/cold-chain; accessed Jun. 3, 2023.

Sales literature for Nomadic Pre-qualified Shipping System, ISC, Inc., Phoeniz, AZ (2001).

Thermosafe Catalog, SCA Packaging North America, Arlington Heights, Illinois (2004).

* cited by examiner

SHIPPING SYSTEM FOR STORING AND/OR TRANSPORTING TEMPERATURE-SENSITIVE MATERIALS

CROSS-REFERENCE TO RELATED APPLICATIONS

The present application claims the benefit under 35 U.S.C. 119(e) of U.S. Provisional Patent Application No. 63/047,835, inventors Anthony Rizzo et al., filed Jul. 2, 2020, the disclosure of which is incorporated herein by reference in its entirety.

BACKGROUND OF THE INVENTION

The present invention relates generally to shipping systems for storing and/or transporting temperature-sensitive materials and relates more particularly to a novel such shipping system.

It is often desirable to store and/or to transport temperature-sensitive materials, examples of such materials including, but not being limited to, pharmaceuticals, biological samples, foods, and beverages. As a result, various types of shipping systems for storing and/or transporting such materials have been devised, some of these shipping systems being parcel-sized shipping systems and some of these shipping systems being pallet-sized shipping systems. Typically, such parcel-sized shipping systems include an insulated container having a cavity for receiving a temperature-sensitive material. Often, the temperature-sensitive material is housed within a product or payload container, the product or payload container (with the temperature-sensitive material disposed therewithin) being placed in the cavity of the insulated container. Such shipping systems often also include a phase-change material disposed within the insulated container for maintaining the temperature-sensitive material within a desired temperature range. In many instances, such as when the desired temperature range for the temperature-sensitive material is below the ambient temperature outside the insulated container, the phase-change material is refrigerated or frozen prior to being placed in the insulated container so that the phase-change material can act as a coolant.

An example of a parcel-sized shipping system of the type described above is illustrated by U.S. Patent Application Publication No. US 2019/0210790 A1, inventors Rizzo et al., which was published Jul. 11, 2019, and which is incorporated herein by reference. According to this publication, in one embodiment, the system includes an outer box having four side walls, bottom closure flaps, and top closure flaps. A vacuum insulated panel (VIP) is detachably coupled to one of the top closure flaps and is removably covered by a cover. An insulation unit is removably positioned within the outer box, the insulation unit including a plurality of VIPs arranged to define a cavity bounded by a bottom wall and four side walls. A disposable liner is removably mounted on the insulation unit. The liner may be a thermoformed sheet and may cover the interior and top surfaces of the insulation unit. A plurality of temperature-control members and a product box may be removably positioned in the liner. Preferably, the liner is shaped so that the temperature-control members snugly fit around all sides of the product box.

Other documents of interest may include the following, all of which are incorporated herein by reference: U.S. Pat. No. 6,868,982, inventor Gordon, issued Mar. 22, 2005; U.S. Pat. No. 9,045,278, inventors Mustafa et al., issued Jun. 2, 2015; U.S. Pat. No. 5,897,017, inventor Lantz, issued Apr. 27, 1999; U.S. Pat. No. 6,257,764, inventor Lantz, issued Jul. 10, 2001; U.S. Pat. No. 5,924,302, inventor Derifield, issued Jul. 20, 1999; U.S. Pat. No. 6,044,650, inventors Cook et al., issued Apr. 4, 2000; U.S. Pat. No. 5,709,307, inventors Rosado et al., issued Jan. 20, 1998; U.S. Pat. No. 5,450,977, inventor Moe, issued Sep. 19, 1995; U.S. Pat. No. 5,501,338, inventor Preston, issued Mar. 26, 1996; U.S. Pat. No. 6,244,458, inventors Frysinger et al., issued Jun. 12, 2001; U.S. Pat. No. 6,192,703, inventors Salyer et al., issued Feb. 27, 2001; U.S. Pat. No. 7,950,246, inventors Mayer et al., issued May 31, 2011; U.S. Patent Application Publication No. US 2018/0328644 A1, inventors Rizzo et al., published Nov. 15, 2018; U.S. Patent Application Publication No. US 2005/0224501 A1, inventors Folkert et al., published Oct. 13, 2005; and U.S. Patent Application Publication No. US 2003/0102317 A1, inventor Gordon, published Jun. 5, 2003.

SUMMARY OF THE INVENTION

It is an object of the present invention to provide a novel shipping system for storing and/or transporting temperature-sensitive materials.

According to one aspect of the invention, there is provided a shipping system for use in transporting and/or storing temperature-sensitive materials, the shipping system comprising (a) an outer box, the outer box comprising a cavity; (b) a product box, the product box disposed within the cavity of the outer box; and (c) a plurality of temperature-control members disposed within the cavity of the outer box, at least some of the temperature-control members comprising a container and a quantity of dry ice disposed within the container, at least some of the containers being self-contained closed structures that are separable from other containers.

In a more detailed feature of the invention, the product box may be rectangular and may comprise a top surface, a bottom surface, a front surface, a rear surface, a left side surface, and a right side surface, and the top surface, the bottom surface, the front surface, the rear surface, the left side surface, and the right side surface of the product box may be completely covered by the plurality of temperature-control members.

In a more detailed feature of the invention, the shipping system may further comprise insulation disposed within the cavity of the outer box, and the insulation may be exterior to the product box and the plurality of temperature-control members.

In a more detailed feature of the invention, the plurality of temperature-control members may comprise exactly six temperature-control members, and each of the six temperature-control members may contact and completely cover a different one of the top surface, the bottom surface, the front surface, the rear surface, the left side surface, and the right side surface of the product box.

In a more detailed feature of the invention, the shipping system may further comprise a liner assembly, the liner assembly may comprise a liner and a liner support, and the liner assembly may be removably mounted in the outer box.

In a more detailed feature of the invention, the liner may comprise a first liner piece and a second liner piece, the first liner piece may comprise a sheet reversibly transformable between a first planar structure and a first generally U-shaped structure, the second liner piece may comprise a sheet reversibly transformable between a second planar structure and a second generally U-shaped structure, and the first and second liner pieces may be arranged offset from one another by approximately 90 degrees.

In a more detailed feature of the invention, the liner support may be reversibly transformable between a third planar structure and a structure having a bottom, four sides, and an open top, and the first liner piece and the second liner piece may be arranged on the liner support.

In a more detailed feature of the invention, the plurality of temperature-control members may comprise an upper container holding a first quantity of dry ice, a lower container holding a second quantity of dry ice, and a scaffolding structure disposed between the upper container and the lower container for use in defining one or more compartments for holding additional dry ice.

In a more detailed feature of the invention, the scaffolding structure may be shaped to include a frame for receiving the product box and a plurality of baffles extending outwardly from the frame.

According to another aspect of the invention, there is provided a shipping system for use in transporting and/or storing temperature-sensitive materials, the shipping system comprising (a) an outer box, the outer box comprising a cavity; (b) an insulation unit, the insulation unit disposed within the cavity of the outer box; (c) a liner assembly, the liner assembly removably mounted on or in the insulation unit, the liner assembly defining a receptacle having a cavity bounded by a bottom, four sides, and an open top, the liner assembly comprising (i) a first liner piece, wherein the first liner piece comprises a first planar sheet reversibly foldable into a first generally U-shaped structure; (ii) a second liner piece, wherein the second liner piece comprises a second planar sheet foldable into a second generally U-shaped structure, wherein the first and second liner pieces are arranged offset from one another by approximately 90 degrees; and (iii) a liner support, wherein the liner support is foldable into a structure having a bottom, four sides, and an open top, and wherein the first liner piece and the second liner piece are arranged on or in the liner support; (d) a product box, the product box being removably disposed within the cavity of the liner assembly; and (e) at least one temperature-control member, the at least one temperature-control member being disposed within the cavity of the liner assembly.

In a more detailed feature of the invention, the shipping system may further comprise a riser, the riser may be removably disposed within the cavity of the liner assembly, and at least some of the at least one temperature-control member may be seated on the riser.

In a more detailed feature of the invention, the at least one temperature-control member may comprise dry ice.

In a more detailed feature of the invention, the at least one temperature-control member may comprise a flexible mat, the flexible mat may comprise exactly two pouches, each pouch may contain a quantity of phase-change material, and each pouch may substantially completely cover a surface of the product box.

According to yet another aspect of the invention, there is provided a kit for assembling a shipping system suitable for use in transporting and/or storing temperature-sensitive materials, the kit comprising (a) an insulation unit, the insulation unit shaped to include a cavity bounded by a bottom wall, four side walls, and an open top; (b) a liner assembly, the liner assembly being removably mounted on or in the insulation unit, the liner assembly being shaped to include a cavity, wherein the cavity of the liner assembly extends into the cavity of the insulation unit, wherein the liner assembly comprises (i) a first liner piece, wherein the first liner piece comprises a sheet foldable into a generally U-shaped structure; (ii) a second liner piece, wherein the second liner piece comprises a sheet foldable into a generally U-shaped structure, wherein the first and second liner pieces are arranged offset from one another by approximately 90 degrees; and (iii) a liner support, wherein the liner support is foldable into a structure having a bottom, four sides, and an open top, and wherein the first liner piece and the second liner piece are arranged on or in the liner support; (c) a product box, the product box being removably disposed within the cavity of the liner assembly, the product box being designed to hold a payload; (d) an insulated lid, the insulated lid covering the cavity of the insulation unit; and (e) a plurality of alternative sets of temperature-control members, each alternative set of temperature-control members being removably disposed within the cavity of the liner assembly and being designed to maintain the payload within a different temperature range.

In a more detailed feature of the invention, the kit may further comprise a riser, and the riser may be removably disposed within the cavity of the liner assembly.

In a more detailed feature of the invention, the riser may comprise a rectangular frame having an opening, the opening may be dimensioned to receive the product box, and at least some of the temperature-control members may be positionable on the riser.

According to still another aspect of the invention, there is provided a kit for assembling at least one shipping system suitable for use in transporting and/or storing temperature-sensitive materials, the kit comprising (a) a first shipper, the first shipper comprising (i) a first insulation unit, the first insulation unit shaped to include a cavity bounded by a bottom wall, a plurality of side walls, and an open top, the plurality of side walls collectively defining a top edge, (ii) a first insulated lid, the first insulated lid removably mountable over the first insulation unit to close the cavity of the first insulation unit, (iii) a first liner assembly, the first liner assembly being removably mountable on or in the first insulation unit, the first liner assembly being shaped to include a cavity and a flange, wherein the cavity of the first liner assembly is dimensioned to extend into the cavity of the first insulation unit and wherein the flange of the first liner assembly is dimensioned to extend over the top edge of the first insulation unit, and (iv) a first product box, the first product box being removably positionable within the cavity of the first liner assembly, the first product box being designed to hold a payload; (b) a second shipper, the second shipper comprising (i) a second insulation unit, the second insulation unit shaped to include a cavity bounded by a bottom wall, a plurality of side walls, and an open top, the plurality of side walls collectively defining a top edge, (ii) a second insulated lid, the second insulated lid removably mountable over the second insulation unit to close the cavity of the second insulation unit, (iii) a second liner assembly, the second liner assembly being removably mountable on or in the second insulation unit, the second liner assembly being shaped to include a cavity and a flange, wherein the cavity of the second liner assembly is dimensioned to extend into the cavity of the second insulation unit and wherein the flange of the second liner assembly is dimensioned to extend over the top edge of the second insulation unit, and (iv) a second product box, the second product box being removably positionable within the cavity of the second liner assembly, the second product box being designed to hold a payload, wherein the second product box is dimensioned to hold a differently-sized payload than the first product box; (c) wherein each of the first and second liner assemblies comprises (i) a first liner piece, wherein the first liner piece comprises a sheet foldable into a generally U-shaped structure; (ii) a second liner piece, wherein the second liner piece comprises a sheet foldable into a generally U-shaped structure, wherein the first and second liner pieces are arranged offset from one another by approximately 90 degrees; and (iii) a liner support, wherein the liner support is foldable into a structure having a bottom, four sides, and an open top, and wherein the first liner piece and the second liner piece are arranged on or in the liner support; and (d) a set of temperature-control members, the set of temperature-control members being dimensioned for alternative deployment in the cavity of the first liner assembly, snugly fitting around the first product box, or the cavity of the second liner assembly, snugly fitting around the second product box.

In a more detailed feature of the invention, at least some of the temperature-control members may comprise a container and a quantity of dry ice disposed within the container, and at least some of the containers may be self-contained closed structures that are separable from the other containers, According to a further aspect of the invention, there is provided a method comprising (a) providing a shipping system of any of the types described above for use in transporting and/or storing temperature-sensitive materials; (b) using the shipping system to transport a first payload; (c) then, cleaning or replacing the liner assembly; and (d) then, using the shipping system to transport a second payload.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts.

DETAILED DESCRIPTION OF THE INVENTION

Figure 1:
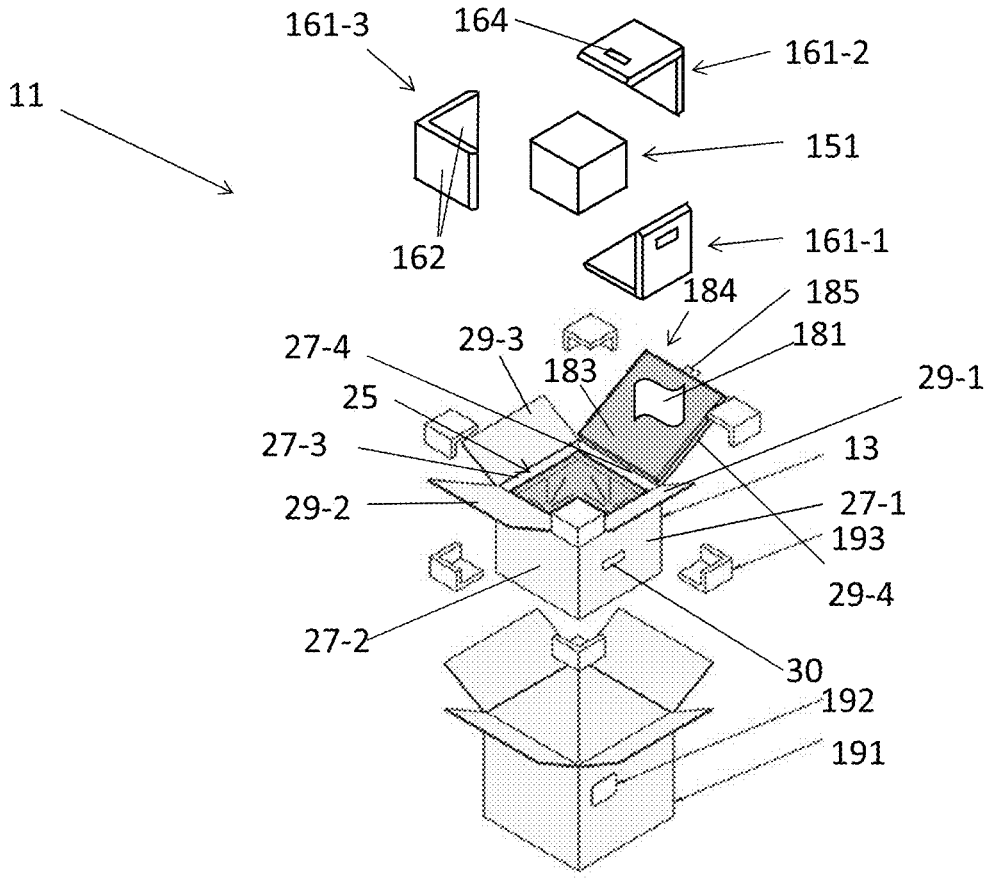
FIG. 1 is a partly exploded perspective view, broken away in part, of a first embodiment of a shipping system suitable for use in storing and/or transporting temperature-sensitive materials, the shipping system being constructed according to the teachings of the present invention.
Figure 2:
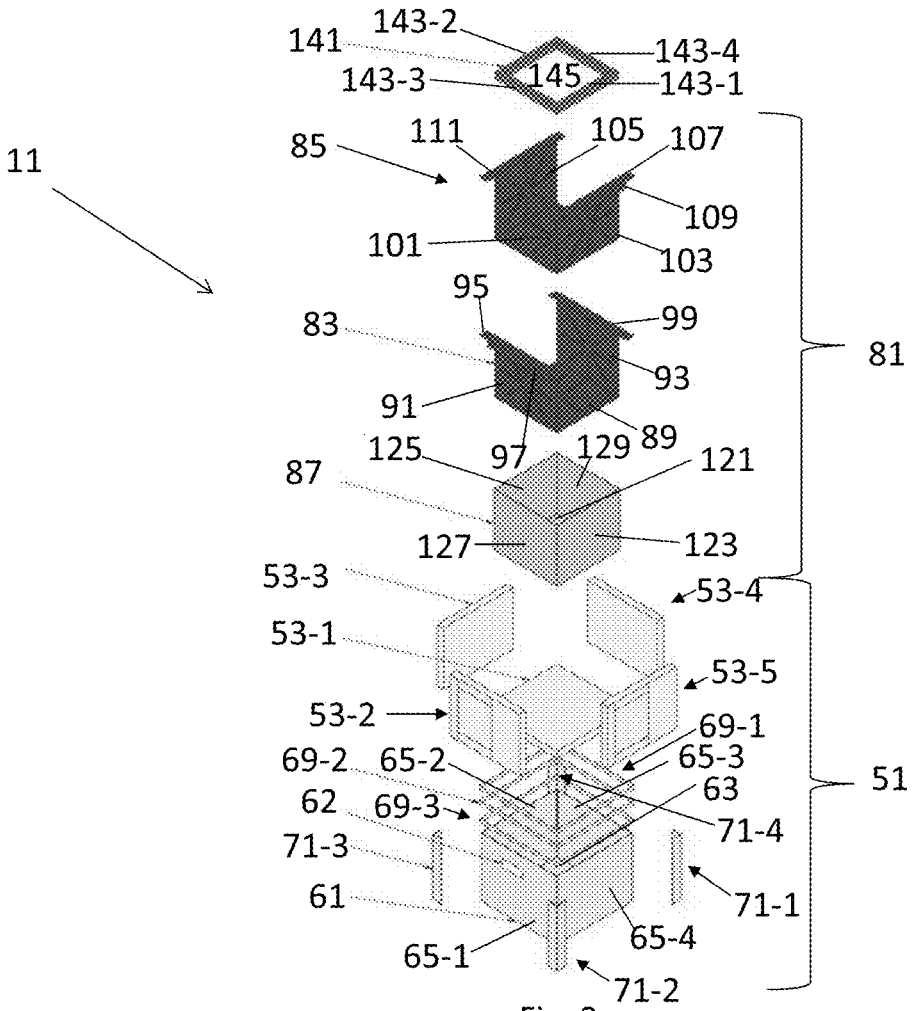
FIG. 2 is a partly exploded perspective view of the shipping system of FIG. 1, with certain components of the shipping system not being shown to reveal other components.

Referring now to FIGS. 1 and 2, there are shown various views of a first embodiment of a shipping system suitable for use in storing and/or transporting temperature-sensitive materials, the shipping system being constructed according to the present invention and being represented generally by reference numeral 11. For clarity and/or ease of illustration, certain details of shipping system 11 that are discussed elsewhere in this application or that are not critical to an understanding of the invention may be omitted from one or both of FIGS. 1 and 2 and/or may be shown in one or both of FIGS. 1 and 2 in a simplified manner.

System 11 may be used to maintain a payload within a desired temperature range for an extended period of time. Solely for illustrative purposes and not to be limited thereto, system 11 may be configured to maintain a parcel-sized payload within a temperature range of +2° C. to +8° C. for a period of up to 96 hours or longer or, alternatively, may be configured to maintain a parcel-sized payload within a temperature range of +15° C. to +25° C. for a period of up to 96 hours or longer or, alternatively, may be configured to maintain a parcel-sized payload within a temperature range of −15° C. to −25° C. for a period of up to 96 hours or longer.

System 11 may comprise an outer box 13. Outer box 13, which may be, for example, a conventional corrugated cardboard box or carton, may comprise a rectangular prismatic cavity 25 bounded by a plurality of rectangular side walls 27-1 through 27-4, a plurality of bottom closure flaps (not shown), and a plurality of top closure flaps 29-1 through 29-4. Adhesive strips of tape or other closure means (not shown) may be used to retain, in a closed condition, the bottom closure flaps and/or the top closure flaps 29-1 through 29-4. A label 30 may be adhered to or otherwise affixed to outer box 13.

System 11 may further comprise an insulation unit 51 (seen best in FIG. 2). Insulation unit 51 may comprise a plurality of vacuum insulated panels 53-1 through 53-5, which may be conventional and may be similar or identical to one another in size, shape and/or composition. Vacuum insulated panels 53-1 through 53-5 may be arranged with vacuum insulated panels 53-2 through 53-5 positioned perpendicularly relative to and sitting directly on top of vacuum insulated panel 53-1 so as to define a generally prismatic cavity bounded by a bottom wall and four side walls. The four side walls may be positioned relative to one another in a "pinwheel"-type arrangement, wherein one end of each vacuum insulated panel abuts the inside major surface of its adjacent vacuum insulated panel. Alternatively, the four side walls may be positioned relative to one another so that one end of each of two parallel vacuum insulated panels abuts the inside major surface of each of the two remaining parallel vacuum insulated panels.

Insulation unit 51 may additionally comprise a support 61. Support 61, which may be made of corrugated cardboard or the like, may be a blank adapted to be folded into a unitary box-like structure configured to include a central portion 63 and four side portions 65-1 through 65-4. (When folded, the adjacent edges of side portions 65-1 through 65-4 may be spaced apart by a small distance.) Central portion 63 may be rectangular, and each of four side portions 65-1 through 65-4 may extend upwardly from a different one of the four sides of the central portion 63. Support 61 may be appropriately dimensioned so that the central portion 63 of support 61 may be positioned under vacuum insulated panel 53-1 and so that side portions 65-1 through 65-4 of support 61 may be positioned along the outside faces of vacuum insulated panels 53-2 through 53-5, as well as along the peripheral edges of vacuum insulated panel 53-1. As will be discussed further below, support 61 may be used, in conjunction with other structural members, to help keep vacuum insulation panels 53-1 through 53-5 assembled together. In addition, support 61 may also provide some additional thermal insulation to insulation unit 51. A label 62 may be affixed to support 61.

Insulation unit 51 may further comprise a plurality of plastic binding straps 69-1 through 69-3. Straps 69-1 through 69-3, which may be conventional binding straps, may be wrapped around the four sides of support 61 and may be used to help retain vacuum insulated panels 53-1 through 53-5 in an assembled state and to keep support 61 in a folded state. It is to be understood that, although three straps 69-1 through 69-3 are shown in the present embodiment, there could be as few as one strap or as many as four or more straps.

Insulation unit 51 may further comprise a plurality of corner boards 71-1 through 71-4. Corner boards 71-1 through 71-4 may be identical to one another. Corner boards 71-1 through 71-4 may be made of Kraft paper and may have a thickness, for example, of 0.06 to 0.08 inch. Corner boards 71-1 through 71-4 may be positioned vertically at the four exterior corners defined by support 61 and may help to increase the thermal life of insulation unit 51 by keeping panels 53-1 through 53-5 together and tighter for a longer period of time and by protecting support 61 and panels 53-1 through 53-5 from physical damage that may be caused by straps 69-1 through 69-3, particularly at the four corners of insulation unit 51. Corner boards 71-1 through 71-4 also may help to increase the length of time that straps 69-1 through 69-3 are able to hold a minimal required tension in a reuse application.

Insulation unit 51 may be assembled as follows: First, support 61 may be folded and then placed in a fixture (not shown), whereby side portions 65-1 through 65-4 may be maintained in a generally perpendicular orientation relative to central portion 63. Next, panel 53-1 may be positioned with its bottom major surface flush on top of central portion 63. Next, panels 53-2 through 53-5 may be positioned on top of panel 53-1 in a "pinwheel" arrangement. (Preferably, the seams of panels 53-1 through 53-5 face outwardly towards support 61.) Next, corner boards 71-1 through 71-4 may be placed around the exterior four corners defined by the support 61. Next, straps 69-1 through 69-3 may be wrapped around support 61 and corner boards 71-1 through 71-4. (Preferably, each of straps 69-1 through 69-3 provides a tension of at least 10 psi.) The resulting structure is a five-sided unit defining a cavity bounded by a bottom and four sides and having an open top. As can be appreciated, in the absence of the combination of support 61, straps 69-1 through 69-3, and corner boards 71-1 through 71-4, there is nothing keeping panels 53-1 through 53-5 in an assembled state.

System 11 may further comprise a liner assembly 81 (seen best in FIG. 2). Liner assembly 81, which may be removably mounted on insulation unit 51, may comprise a two-piece liner, namely, a first liner piece 83 and a second liner piece 85, and may further comprise a liner support 87.

First liner piece 83 may comprise a sheet of material foldable into a generally U-shaped structure. More specifically, when folded, first liner piece 83 may include a bottom wall 89 extending generally horizontally, a left inner wall 91 extending generally perpendicularly upwardly relative to bottom wall 89, and a right inner wall 93 extending generally perpendicularly upwardly relative to bottom wall 89, with left inner wall 91 and right inner wall 93 extending from opposite ends of bottom wall 89. In addition, first liner piece 83 may further include a left top wall 95 extending generally perpendicularly outwardly from the top of left inner wall 91 and a left outer wall 97 extending generally perpendicularly downwardly for a short distance from the outer edge of left top wall 95. Moreover, first liner piece 83 may further include a right top wall 99 extending generally perpendicularly outwardly from the top of right inner wall 93 and a right outer wall (not shown) extending generally perpendicularly downwardly a short distance from the outer edge of right top wall 99 analogously to left outer wall 97.

Second liner piece 85 may comprise a sheet of material foldable into a generally U-shaped structure. More specifically, when folded, second liner piece 85 may include a bottom wall 101 extending generally horizontally, a front inner wall 103 extending generally perpendicularly upwardly relative to bottom wall 101, and a rear inner wall 105 extending generally perpendicularly upwardly relative to bottom wall 101, with front inner wall 103 and rear inner wall 105 extending from opposite ends of bottom wall 101. In addition, second liner piece 85 may further include a front top wall 107 extending generally perpendicularly outwardly from the top of front inner wall 103 and a front outer wall 109 extending generally perpendicularly downwardly a short distance from the outer edge of front top wall 107. Moreover, second liner piece 85 may further include a rear top wall 111 extending generally perpendicularly outwardly from the top of rear inner wall 105 and a rear outer wall (not shown) extending generally perpendicularly downwardly a short distance from the outer edge of rear top wall 111 analogously to front outer wall 109.

Each of first liner piece 83 and second liner piece 85 may be made of a material that is substantially liquid-impermeable and that may easily be cleaned if soiled, and first liner piece 83 and second liner piece 85 may be made of the same type of such a material. For example, first liner piece 83 and second liner piece 85 may be made of a molded polymer (such as a polyethylene terephthalate) or a similarly suitable material.

Liner support 87 may be similar in structure to support 61 but may be smaller in size so that liner support 87 may be removably inserted into the cavity defined by vacuum insulated panels 53-1 through 53-5 of insulation unit 51. Liner support 87 may comprise a single sheet of corrugated cardboard or similar material and may be folded to define a bottom 121, a front 123, a rear 125, a left side 127, and a right side 129. Liner support 87 may be dimensioned so that, when liner support 87 is inserted into insulation unit 51, bottom 121 may be seated on vacuum insulated panel 53-1 (or may be closely spaced therefrom), and one or more of left side 127, rear 125, right side 129, and front 123 may be abutting vacuum insulated panels 53-2 through 53-5, respectively (or may be closely spaced therefrom). Liner support 87 may be incapable of maintaining a folded state on its own and may be maintained in a folded state by virtue of being snugly received within the cavity of insulation unit 51; alternatively, liner support 87 may be maintained in a folded state on its own or may be maintained in a folded state by adhesive tape or other suitable means.

First liner piece 83 may be removably inserted into liner support 87 and, by virtue of being inserted into liner support 87, may be transformed from a generally planar state to the above-described folded state. (First liner piece 83 may be incapable of maintaining a folded state on its own.) When inserted into liner support 87, bottom wall 89 of first liner piece 83 may be seated directly on top of bottom 121 of liner support 87, left inner wall 91 of first liner piece 83 may be positioned against or proximate to left side 127 of liner support 87, left top wall 95 of first liner piece 83 may be positioned directly over or proximate to the top of left side 127 of liner support 87, and left outer wall 97 of first liner piece 83 may be positioned parallel to and spaced a short distance away from left side 127 of liner support 87. In addition, right inner wall 93 of first liner piece 83 may be positioned against or proximate to right side 129 of liner support 87, right top wall 99 of first liner piece 83 may be positioned directly over or proximate to the top of right side 129 of liner support 87, and the right outer wall connected to right top wall 99 may be positioned parallel to and spaced a short distance away from right side 129 of liner support 87.

Second liner piece 85 may also be removably inserted into liner support 87 and, by virtue of being inserted into liner support 87, may be transformed from a generally planar state to the above-described folded state. (Second liner piece 85 may be incapable of maintaining a folded state on its own.) More specifically, bottom wall 101 of second liner piece 85 may be seated directly on top of bottom wall 89 of first liner piece 83, front inner wall 103 of second liner piece 85 may be positioned against or proximate to front 123 of liner support 87, front top wall 107 of second liner piece 85 may be positioned directly over or proximate to the top of front 123 of liner support 87, and front outer wall 109 of second liner piece 85 may be positioned parallel to and spaced a short distance away from front 123 of liner support 87. In addition, rear inner wall 105 of second liner piece 85 may be positioned against or proximate to rear 125 of liner support 87, rear top wall 111 of second liner piece 85 may be positioned directly over or proximate to the top of rear 125 of liner support 87, and the rear outer wall connected to top wall 111 may be positioned parallel to and spaced a short distance away from rear 125 of liner support 87.

First liner piece 83 and second liner piece 85 may be appropriately dimensioned so that, when insulation unit 51 and liner assembly 81 are brought together, the top portions of liner support 87, vacuum insulated panels 53-2 through 53-5, and support 61 may be covered by the combination of first liner piece 83 and second liner piece 85. For example, the top portions of left side 127 of liner support 87, vacuum insulated panel 53-2, and side 65-1 of support 61 may be positioned between left inner wall 91 and left outer wall 97 of first liner piece 83. In this manner, first liner piece 83 and second liner piece 85 may provide some protection to the top portions of vacuum insulated panels 53-2 through 53-5. In addition, the inner-facing exposed surfaces of vacuum insulated panels 53-1 through 53-5 may be covered by (and, thus, protected by) bottom 121, left side 127, rear 125, right side 129, and front 123, respectively, of liner support 87. The protection to the inner-facing exposed surfaces of vacuum insulated panels 53-1 through 53-5 that is afforded by liner support 87 may be particularly advantageous since first liner piece 83 and second liner 85 may have exposed edges that otherwise could cause damage to vacuum insulated panels 53-1 through 53-5. First liner piece 83 and second liner piece 85 may additionally provide some protection to the top, outer surfaces of vacuum insulated panels 53-2 through 53-5.

System 11 may further comprise a riser 141 (seen best in FIG. 2). Riser 141 may be a unitary structure shaped to define a rectangular frame having a front 143-1, a rear 143-2, a left side 143-3, a right side 143-4, and a central opening 145. Riser 141, which may be made of a dimensionally stable foam or similarly suitable material, may be dimensioned to be removably received within the cavity jointly defined by first liner piece 83 and second liner piece 85. As will be discussed further below, riser 141 may be used to position one or more temperature-control members relative to a product box also positioned in the cavity jointly defined by first liner piece 83 and second liner piece 85.

Figure 3:
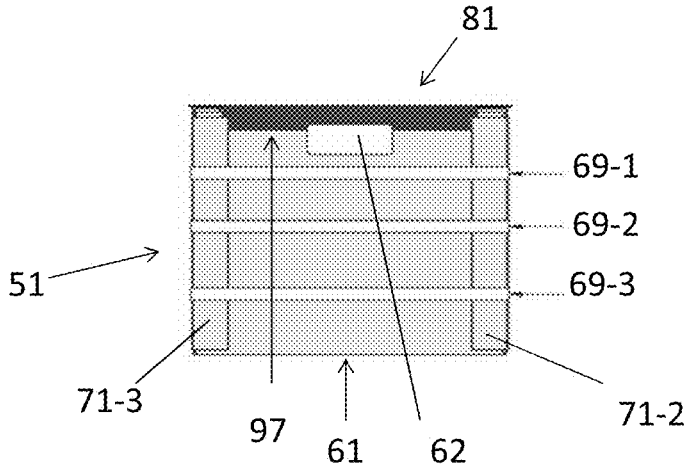
FIG. 3 is a side view, showing the insulation unit and the liner assembly of FIG. 2 in assembled form.

Referring now to FIG. 3, there is shown the assembled combination of insulation unit 51 and liner assembly 81.

Referring back now to FIG. 1, system 11 may further comprise a product box 151. Product box 151 may be used to removably receive temperature-sensitive materials (not shown). Product box 151, which may be a conventional corrugated cardboard box, may be appropriately dimensioned to be removably received within the cavity collectively defined by first liner piece 83 and second liner piece 85. In the present embodiment, product box 151 may be dimensioned to hold a payload volume of approximately 6 L; however, it is to be understood that product box 151 may be altered to accommodate a lesser or greater volume and/or may have a different shape than that shown.

System 11 may further comprise a plurality of temperature-control members 161-1 through 161-3. Temperature-control members 161-1 through 161-3, which may be identical to one another, may be appropriately dimensioned to be received, along with product box 151, within the cavity collectively defined by first liner piece 83 and second liner piece 85. Materials suitable for use as temperature-control members 161-1 through 161-3 are exemplified by, but are not limited to, conventional ice packs, conventional gel packs, or refrigerant packs of the type disclosed in U.S. Pat. No. 9,598,622 B2, inventors Formato et al., issued Mar. 21, 2017, and U.S. Patent Application Publication No. US 2018/0093816 A1, inventors Longley et al., published Apr. 5, 2018, both of which are incorporated herein by reference. A label 164 may be affixed to each of temperature-control members 161-1 through 161-3.

According to one embodiment, temperature-control members 161-1 through 161-3 may be in the form of flexible mats having a plurality of discrete sealed pouches 162, each pouch 162 containing a quantity of a phase-change material (PCM). The phase-change material may be any phase-change material including any water-based or organic phase-change material. For example, if the phase-change material is water-based, the phase-change material may be water, a mixture of water and a thickener (e.g., a polysaccharide thickener) to produce a gelled water mixture, or a water/salt solution with an optional thickener.

Alternatively, if the phase-change material is an organic phase-change material, the phase-change material may be a gelled organic phase-change material, such as is disclosed in U.S. Pat. No. 9,598,622 B2 and U.S. Patent Application Publication No. US 2018/0093816 A1. More specifically, a suitable gelled organic phase-change material may comprise one or more n-alkanes, such as n-tetradecane (C14), n-pentadecane (C15), n-hexadecane (C16), n-heptadecane (C17), n-octadecane (C18), or combinations thereof, together with a gelling agent in the form of a styrene-ethylene-butylene-styrene triblock copolymer and/or a styrene-ethylene-propylene-styrene triblock copolymer. Solely for purposes of illustration, where, for example, system 11 is designed to keep a payload within a temperature range of +2° C. to +8° C., the gelled phase-change material may comprise a mixture of n-tetradecane (C14) and KRATON™ G1654 styrene-ethylene-butylene-styrene (SEBS) tri-block copolymer. Alternatively, where, for example, system 11 is designed to keep a payload within a temperature range of +15° C. to +25° C., the gelled phase-change material may comprise a mixture of n-hexadecane (C16) and KRATON™ G1654 styrene-ethylene-butylene-styrene (SEBS) tri-block copolymer. Each pouch of temperature-control members 161-1 through 161-3 may contain suitable masses of the phase-change material and the gelling agent for the particular application to which system 11 is put. For example, for the particular applications described above, each pouch may contain approximately 150-200 g of the n-alkane(s) and approximately 12-18 g of the gelling agent.

In the present embodiment, there are three temperature-control members 161-1 through 161-3, and each of temperature-control members 161-1 through 161-3 has two generally rectangular pouches 162, each pouch 162 being adapted to substantially cover the entirety of a different face of product box 151; however, it is to be understood that the number of temperature-control members 161-1 through 161-3 and the number and shape of pouches 162 in temperature-control members 161-1 through 161-3 are merely illustrative. Consequently, the number of temperature-control members 161, as well as the number and shape of pouches 162 therein, may be varied while still coming within the scope of the present invention. Moreover, while, in the present embodiment, each pouch 162 of temperature-control members 161-1 through 161-3 contains the same quantity and type of phase-change material, this need not be so as some of temperature-control members 161-1 through 161-3 may contain different phase-change materials than others of temperature-control members 161-1 through 161-3 and/or different pouches of the same temperature-control member may contain different types of phase-change materials. Furthermore, although not shown in the present embodiment, system 11 may include multiple layers of temperature-control members, such as an inner layer of temperature-control members and an outer layer of temperature-control members, which layers may contain the same or different phase-change materials.

Riser 141 may be appropriately dimensioned so that a lower pouch of temperature-control member 161-1 may be received within central opening 145, so that an upper pouch of temperature-control member 161-1 may be seated upon front 143-1, so that a lower pouch of temperature-control member 161-2 may be seated upon right side 143-4, so that an upper pouch of temperature-control member 161-2 may be seated on top of product box 151, so that a first pouch of temperature-control member 161-3 may be seated upon left side 143-3, and so that a second pouch of temperature-control member 161-3 may be seated upon rear 143-2. The thickness of riser 141 may be selected so that the vertical portions of temperature-control members 161-1 through 161-3 may be substantially centered relative to product box 151.

Preferably, first liner piece 83, second liner piece 85, riser 141, product box 151, and temperature-control members 161-1 through 161-3 are dimensioned so that temperature-control members 161-1 through 161-3 fit snugly around product box 151 within first and second liner pieces 83 and 85.

System 11 may further comprise a vacuum insulated panel 181. Vacuum insulated panel 181, which may be conventional and, in fact, may be similar or identical to vacuum insulated panel 53-1, may be removably secured, for example, using complementary hook and loop fasteners (not shown), adhesive fasteners, or other suitable means, to the interior face of top closure flap 29-1. In addition, a protective cover 183, which may be made of the same material as first liner piece 83 and second liner piece 85, may be removably secured, for example, using complementary hook and loop fasteners (not shown), adhesive fasteners, or other suitable means, to vacuum insulated panel 181 to cover the exposed surfaces thereof. Vacuum insulated panel 181 is preferably positioned on top closure flap 29-1, and cover 183 is preferably positioned on vacuum insulated panel 181 in such a way that the cavity formed by first liner piece 83 and second liner piece 85 may be closed simply by the closure of top closure flap 29-1. In this regard, cover 183 and vacuum insulated panel 181 may be collectively regarded as a lid assembly 184 for insulation unit 51.

A tab 185, which may be made of a sheet of polymeric material, such as a polyvinyl chloride or a similar material, may be secured, for example, by adhesive or similar means, to the interior face of top closure flap 29-1, and tab 185 may extend across a free edge of top closure flap 29-1. In this manner, a user may swing open top closure flap 29-1 from a closed state by pulling generally upwardly on tab 185. Preferably, vacuum insulated panel 181 and protective cover 183 are dimensioned so that, when top closure flap 29-1 is closed, cover 183 is seated directly on top of the top surfaces of first liner piece 83 and second liner piece 85, and vacuum insulated panel 181 is disposed within the top portion of cavity 25 of outer box 13.

System 11 may further comprise a protective container 191. Protective container 191 is not intended to be used during shipment of a payload or even during delivery of the system to an end user, but rather, is merely intended to protect outer box 13, together with any of the components disposed therewithin, during internal shipment of the system from one facility of the manufacturer to another facility of the manufacturer. A label 192 may be affixed or otherwise secured to protective container 191. Foam spacers 193 may be used to provide additional protection to the components disposed within protective container 191.

Although not shown, system 11 may further comprise one or more environmental data loggers, one or more temperature indicators, and the like, such as are disclosed in U.S. Patent Application Publication No. US 2019/0210790 A1.

System 11 minus temperature-control members 161-1 through 161-3, protective container 191, and foam spacers 193 may be referred to herein as a shipper.

One may assemble system 11 (excluding protective container 191 and foam blocks 193) as follows: Outer box 13 may be formed from a suitable blank, and the bottom closure flaps of outer box 13 may be closed and, preferably, sealed. First liner piece 83 and second liner piece 85 may be inserted into liner support 87 to form liner assembly 81, and liner assembly 81 may be coupled to insulation unit 51. The combination of insulation unit 51 and liner assembly 81 may be placed in outer box 13. Cover 183 may be secured to vacuum insulated panel 181, and the combination of cover 183 and vacuum insulated panel 181 may be secured to closure flap 29-1. (Tab 185 may be secured to closure flap 29-1 prior to securement of cover 183 and vacuum insulated panel 181 to closure flap 29-1.)

Riser 141 may be placed in the cavity collectively formed by first liner piece 83 and second liner piece 85. Next, temperature-control member 161-1 may be placed in the liner cavity, with one of the two pouches of temperature-control member 161-1 positioned within the central opening 145 of riser 141 and the other pouch extending generally upwardly. Product box 151 (which may contain temperature-sensitive materials) may then be placed in the liner cavity on top of the bottom pouch of temperature-control member 161-1. Temperature-control members 161-2 and 161-3 may then be placed in the liner cavity around the remaining exposed faces of product box 151. Next, top closure flaps 29-1 through 29-4 may be closed, the closure of top closure flap 29-1 causing lid assembly 184 to be swung down on top of liner assembly 81 and insulation unit 51.

The product load and temperature-control members 161-1 through 161-3 may be preconditioned at appropriate temperatures prior to being loaded into system 11 at a particular temperature. For example, to maintain the temperature-sensitive materials within a temperature range of +2° C. to +8° C., the product load may be pre-conditioned at +5° C.±3° C., temperature-control members 161-1 through 161-3 may contain a phase-change material having a phase-change temperature of +5° C. and may be pre-conditioned at +3° C.±3° C., and the above-described steps for assembling system 11 may be conducted at +5° C.±3° C. Alternatively, to maintain the temperature-sensitive materials within a temperature range of +15° C. to +25° C., the product load may be pre-conditioned at +20° C.±5° C., temperature-control members 161-1 through 161-3 may contain a phase-change material having a phase-change temperature of +17° C. and may be pre-conditioned at +20° C.±5° C., and the above-described steps for assembling system 11 may be conducted at +20° C.±5° C. Moreover, as discussed above, in other embodiments, it may be desirable to have different pouches of the same temperature-control member or of different temperature-control members contain different types of phase-change materials. For example, according to one embodiment, some of temperature-control members 161-1 through 161-3 may contain a first type of phase-change material, for example, a phase-change material having a phase-change temperature of +17° C., and some of temperature-control members 161-1 through 161-3 may, instead, contain a second type of phase-change material, for example, a phase-change material having a phase-change temperature of +24° C. Alternatively, according to another embodiment, one, some or all of temperature-control members 161-1 through 161-3 may have one pouch of a given temperature-control member containing a first type of phase-change material, for example, a phase-change material having a phase-change temperature of +17° C. and may have another pouch (e.g., the other of two pouches of the same temperature-control member) containing a second type of phase-change material, for example, a phase-change material having a phase-change temperature of +24° C. Furthermore, in certain embodiments, whether the same phase-change materials or different phase-change materials are used, it may be desirable, in certain instances, to precondition all of the temperature-control members at the same preconditioning temperature and, in other instances, to precondition some temperature-control members at a first temperature and to precondition other temperature control-members at a second (i.e., different) temperature. For example, where some temperature-control members contain a first type of phase-change material having a first phase-change temperature and where some temperature-control members contain a second type of phase-change material having a different phase-change temperature, it may be desirable, in certain instances, to precondition the two types of temperature-control members at the same or different preconditioning temperatures.

According to another aspect of the invention, system 11 may be used as follows: First, system 11 (excluding protective container 191 and foam spacers 193) may be assembled by a first party in the manner indicated above, except that temperature-control members 161-1 through 161-3 may be omitted from the assembly of system 11. (In addition, product box 151 may be devoid of product.) Then, system 11—minus temperature-control members 161-1 through 161-3—may be shipped from the first party to a second party. Concurrently with the shipping of system 11—minus temperature-control members 161-1 through 161-3 (or therebefore or thereafter), temperature-control members 161-1 through 161-3 may also be shipped from the first party to the second party. Next, the second party may precondition temperature-control members 161-1 through 161-3. Next, while in a temperature-controlled environment, the second party may open system 11, insert the preconditioned temperature-control members 161-1 through 161-3 into liner assembly 81 of system 11, and then re-close system 11. Next, the second party may transport system 11 to a third party, the transport preferably being performed using a refrigerated vehicle. The third party may then use system 11 immediately or may keep it refrigerated until the third party is ready for its use. When ready for its use, the third party may open system 11 and may check a temperature indicator within system 11 to see if the current temperature of product box 151 is in a desired range. If the temperature indicator indicates that the current temperature is not within the desired range, system 11 is returned to the second party for reconditioning and no product is shipped therein. If the temperature indicator indicates that the current temperature is within the desired range, the third party may remove the temperature indicator from system 11 and may pack a product in product box 151. (The removed temperature indicator may then be shipped back to the first party or the second party.) The third party may then ship system 11, minus the temperature indicator but with the product, to a fourth party. The fourth party may then remove the product from product box 151 and then return system 11 to the first party for cleaning, refurbishment and reuse.

Alternatively, in another embodiment, the roles of the above-described second and third parties may be performed by a single party, and the role of the fourth party may be eliminated. More specifically, system 11—minus protective container 191, foam spacers 193, and temperature-control members 161-1 through 161-3—may be shipped from a first party to a second party. Concurrently with the shipping of the foregoing components of system 11 (or therebefore or thereafter), temperature-control members 161-1 through 161-3 may also be shipped from the first party to the second party. When the second party wishes to ship a product, the second party may precondition, if needed, temperature-control members 161-1 through 161-3. Next, the second party may load the payload into product box 151, then may open system 11 and insert temperature-control members 161-1 through 161-3 and product box 151 into liner assembly 81 of system 11, and then may re-close system 11. Next, the second party may transport the thus-loaded system 11 to a third party. The third party may then remove the product from product box 151 and then return system 11 to the first party or to the second party for cleaning, refurbishment and reuse.

The cleaning and/or refurbishment of system 11 (excluding protective container 191 and foam spacers 193) for reuse may comprise the following (or some portion thereof): Removal of temperature-control members 161-1 through 161-3 from liner assembly 81, inspection of temperature-control members 161-1 through 161-3 for damage, and replacement of any damaged temperature-control members 161-1 through 161-3; removal of lid assembly 184 from outer box 13, separation of vacuum insulated panel 181 from cover 183, inspection of cover 183 and vacuum insulated panel 181 for damage, and replacement of any damaged parts; removal of liner assembly 81 and insulation unit 51 from outer box 13, separation of liner assembly 81 from insulation unit 51, inspection of the individual components of liner assembly 81 and of the individual components of insulation unit 51 for damage (and checking that tension of straps 69-1 through 69-3 is acceptable), and replacement of any damaged parts; and replacement of outer box 13. If one or more of liner assembly 81, cover 183, and temperature-control members 161-1 through 161-3 are soiled, but are not otherwise damaged, these items may be cleaned (e.g., wiped with 70% isopropyl alcohol solution) and reused. Such cleaning and reuse of these items may take place even if there is no discernible soiling of these items. Product box 151 may also be replaced if soiled or damaged.

System 11 possesses a number of advantageous features. One advantageous feature of system 11 is the design of liner assembly 81. As can be appreciated, the various components of liner assembly 81, namely, first liner piece 83, second liner piece 85, and liner support 87 may be constructed as flat members and may subsequently be folded and assembled to form a five-sided liner assembly. This may be more desirable, from a manufacturing standpoint than the thermoforming of a comparable unitary liner. Moreover, because first liner piece 83, second liner 85, and liner support 87 may be stored in a flat condition, both before use and after use, there may be a savings in storage space.

Another advantageous feature of system 11 is the use of riser 141 to center phase-change material relative to product box 151. The use of riser 141 obviates the need for the liner to be shaped to include an internal shelf for this purpose.

Still another advantageous feature of system 11 is the use of temperature-control members that have a single pouch of phase-change material that substantially covers the entirety of a face of product box 151. By having a single pouch of phase-change material on each face of product box 151, as opposed to having multiple, spaced-apart pouches of phase-change material on each face of product box 151, the thermal protection afforded by the phase-change material may be maximized.

Still yet another advantageous feature is that liner assembly 81 may protect vacuum insulated panels 53-1 through 53-5 from becoming soiled, such as by the items that are placed within the liner cavity (e.g., product box 151 and its contents, temperature-control members 161-1 through 161-3) or otherwise. This is particularly the case where liner assembly 81 is made of a liquid impermeable material and does not contain any seams, such as may be the case, for example, where liner assembly 81 is made by thermoforming a single sheet of plastic.

Still a further advantageous feature of system 11 is that liner assembly 81 may be removably mounted on insulation unit 51. In this manner, after system 11 has been used, liner assembly 81 may be removed from insulation unit 51 and may be cleaned (assuming that liner assembly 81 is made of a material that lends itself to being cleaned) or replaced, with a cleaned or replacement liner assembly 81 then being mounted on insulation unit 51 for a subsequent use. In this manner, problems like cross-contamination, resulting from multiple uses, may be minimized.

Still a further advantageous feature of system 11 is that liner assembly 81 may protect vacuum insulated panels 53-1 through 53-5 from damage, such as may occur due to contact with product box 151 and/or temperature-control members 161-1 through 161-3. Relatedly, cover 183 may protect vacuum insulated panel 181 from damage.

Still a further advantageous feature of system 11 is that liner assembly 81 and riser 141 may be sized and shaped relative to product box 151 and to temperature-control members 161-1 through 161-3 so that temperature-control members 161-1 through 161-3 may be snugly and correctly positioned around product box 151, with little available volume for temperature-control members 161-1 through 161-3 to move during shipping.

Still a further advantageous feature of system 11 is that lid assembly 184, which includes vacuum insulated panel 183, may be coupled to one of the top flaps of outer box 13. As a result of this integrated construction, the closing of top flap 29-1 of outer box 13 automatically results in the correct placement of vacuum insulated panel 181 on top of liner assembly 81 and insulation unit 15, thereby creating a closed volume for containing product box 151 and temperature-control members 161-1 through 161-3. Moreover, because vacuum insulated panel 181 is detachably secured both to top flap 29-1 and to cover 183, vacuum insulated panel 181 may be periodically inspected (for example, after each use) and replaced if damaged.

Still a further advantageous feature of system 11 is that system 11 may readily lend itself to being refurbished and/or reused. As noted above, components like liner assembly 81 and cover 183 may be made of cleanable and/or disposable materials. Moreover, the removable mounting of components like liner assembly 81, cover 183, and vacuum insulated panel 181 facilitate the inspection of system 11.

Still a further advantageous feature of system 11 is that system 11 may be adapted for maintaining different payloads at different temperature ranges simply by using different temperature-control members. For example, system 11 may be used, in a first job, to maintain a payload at +2° C. to +8° C. by using a first set of temperature-control members, for example, temperature-control members containing phase-change material having a phase-change temperature of +5° C. and then may be used, in a second or alternative job, to maintain a different payload at +15° C. to +25° C. by using a second set of temperature-control members, for example, temperature-control members containing phase-change material having a phase-change temperature of +17° C. In this manner, a shipping party having an array of different types of temperature-control members may simply select an appropriate type of temperature-control member for a particular job.

Still a further advantageous feature of system 11 is that, where temperature-control members 161-1 through 161-3 employ a +5° C. phase-change material of the type described in U.S. Patent Application Publication No. US 2018/0093816, the system can hibernate under refrigeration for up to 5 days without reducing its ability to provide protection for 96 hours.

Many of the systems described herein may use identical types of temperature-control members to keep payloads within a particular temperature range. For example, the temperature-control members used by many of these systems to keep a payload within a temperature range of, for example, +2° C. to +8° C., may be identical, the only difference being the number of such temperature-control members used by these systems and the arrangement of such temperature-control members within the respective systems. As a result, a party may keep inventories of various types of temperature-control members designed for keeping payloads within particular temperature ranges and then may use these temperature-control members, as needed, within the various systems. This is advantageous as it reduces the number of different types of temperature-control members that may be needed by a party using differently-sized systems.

Figure 4:
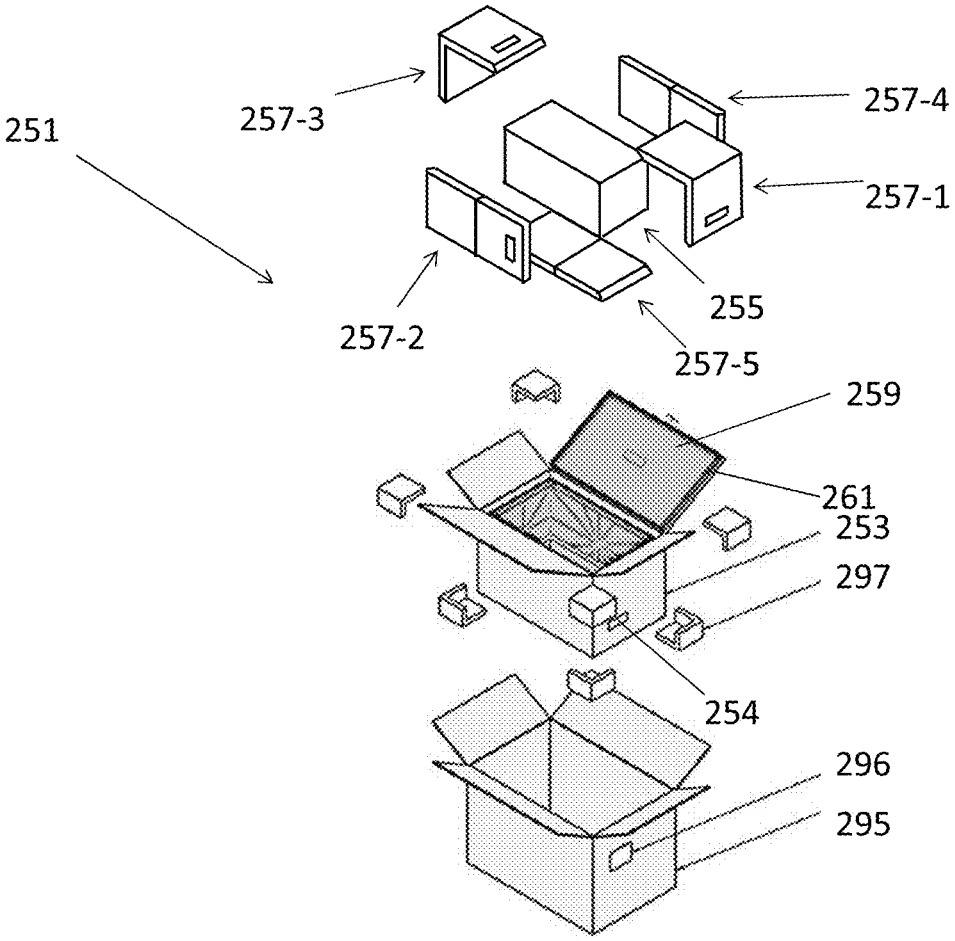
FIG. 4 is a partly exploded perspective view of a second embodiment of a shipping system suitable for use in storing and/or transporting temperature-sensitive materials, the shipping system being constructed according to the teachings of the present invention.
Figure 5:
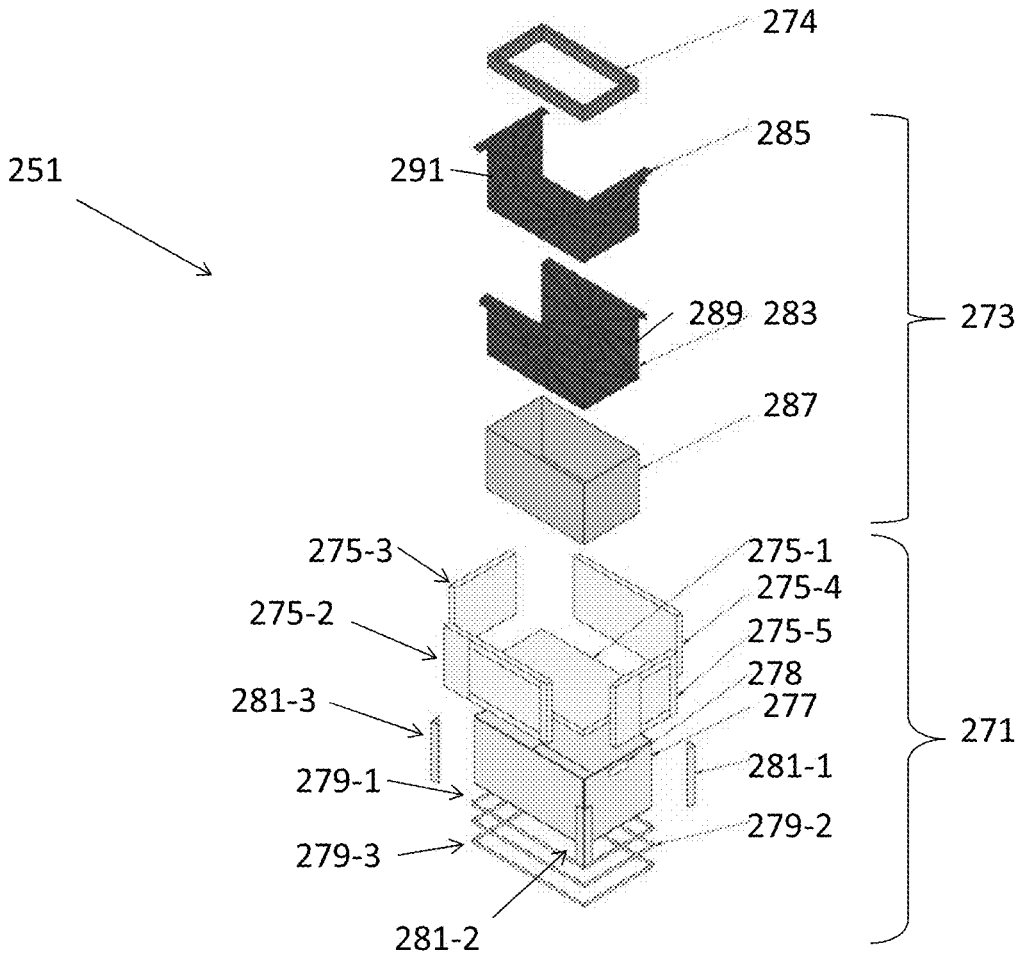
FIG. 5 is a partly exploded perspective view of the shipping system of FIG. 4, with certain components of the shipping system not being shown to reveal other components.

Referring now to FIGS. 4 and 5, there are shown views of a second embodiment of a shipping system suitable for use in storing and/or transporting temperature-sensitive materials, the shipping system being constructed according to the present invention and being represented generally by reference numeral 251. For clarity and/or ease of illustration, certain details of shipping system 251 that are discussed elsewhere in this application or that are not critical to an understanding of the invention may be omitted from one or more of FIGS. 4 and 5 and/or may be shown therein in a simplified manner.

System 251 may be similar in many respects to system 11; however, whereas system 11 may be designed for a payload having a comparatively smaller volume of, for example, 6 L, system 251 may be designed for a payload having a comparatively larger volume, such as, for example, 15 L. As a result, although system 251 and system 11 may have many of the same types of components, some of the components in system 251 may be different in dimensions and/or quantity than corresponding components in system 11.

For example, system 251 may comprise an outer box 253, which may be similar in construction and function to outer box 13 of system 11, except that outer box 253 may have different dimensions than outer box 13. A label 254 may be affixed or otherwise secured to outer box 253. System 251 may also comprise a product box 255, which may be similar in construction and function to product box 151, except that product box 255 may have different dimensions than product box 151.

In addition, system 251 may further comprise a plurality of temperature-control members 257-1 through 257-5. Temperature-control members 257-1 through 257-5 may be similar in construction, function, and dimensions to temperature-control members 161-1 through 161-3 of system 11 but may be present in a different quantity than temperature-control members 161-1 through 161-3 of system 11.

Additionally, system 251 may further comprise a cover 259, which may be similar in construction and function to cover 183 but may be different in size thereto. Cover 259 may be used to cover a vacuum insulated panel (not shown) that is detachably secured to a cover flap 261 of outer box 253.

As seen best in FIG. 5, some additional components that may be disposed within outer box 253 may include an insulation unit 271, a liner assembly 273, and a riser 274.

Insulation unit 271 may be similar in construction and function to insulation unit 51, the only difference between insulation unit 271 and insulation unit 51 being in the respective sizes of some of the components thereof. Accordingly, insulation unit 271 may comprise a plurality of vacuum insulated panels 275-1 through 275-5, a support 277 (shown with a label 278), a plurality of binding straps 279-1 through 279-3, and four corner boards 281-1 through 281-4 (corner board 281-4 not being shown).

Liner assembly 273, which may be similar to liner assembly 81 of system 11, may comprise a first liner piece 283, a second liner piece 285, and a liner support 287. First liner piece 283 and second liner piece 285 may be similar in most respects to first liner piece 83 and second liner piece 85, respectively, of liner assembly 81, the principal differences between the respective liner pieces being (1) that first liner piece 283 and second liner piece 285 are differently dimensioned than first liner piece 83 and second liner piece 85, respectively, (2) that first liner piece 283 is shaped to additionally include a tab 289, and (3) that second liner piece 285 is shaped to additionally include a tab 291. Tabs 289 and 291 may be used to delimit sliding movement of first liner piece 283 and second liner piece 285 relative to one another.

Liner support 287 may be similar to liner support 87, the principal difference between the two liner supports being that they are differently dimensioned.

Riser 274 may be similar to riser 141, the principal difference between the two risers being that they are differently dimensioned.

Figure 6:
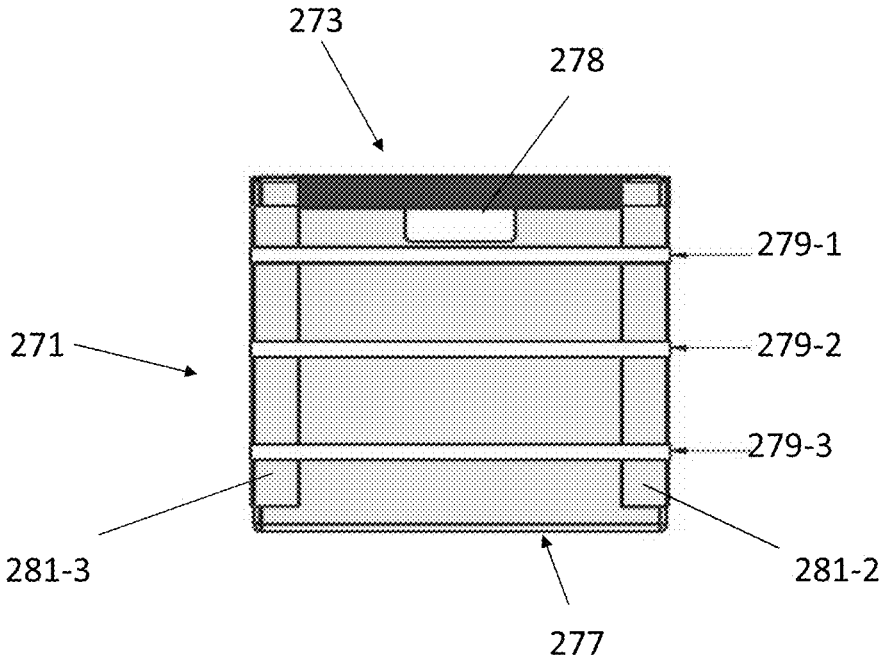
FIG. 6 is a side view, showing the insulation unit and the liner assembly of FIG. 5 in assembled form.

Referring now to FIG. 6, there is shown the assembled combination of insulation unit 271 and liner assembly 273.

Referring back now to FIG. 4, system 251 may further comprise a protective container 295. Protective container 295 may be similar in construction and function to protective container 191, except that protective container 295 may have different dimensions than protective container 191. A label 296 may be affixed or otherwise secured to protective container 295. System 251 may further comprise a plurality of foam spacers 297. Foam spacers 297 may be similar in construction and function to foam spacers 193.

Figure 7:
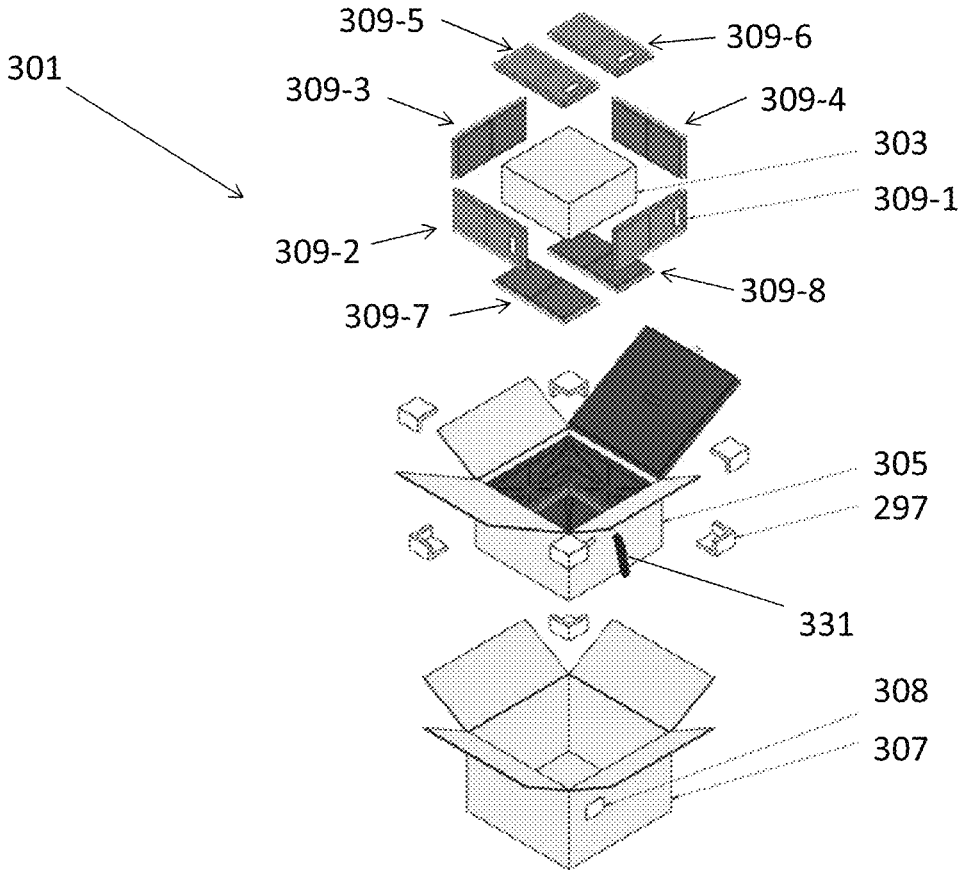
FIG. 7 is a partly exploded perspective view of a third embodiment of a shipping system suitable for use in storing and/or transporting temperature-sensitive materials, the shipping system being constructed according to the teachings of the present invention.
Figure 8:
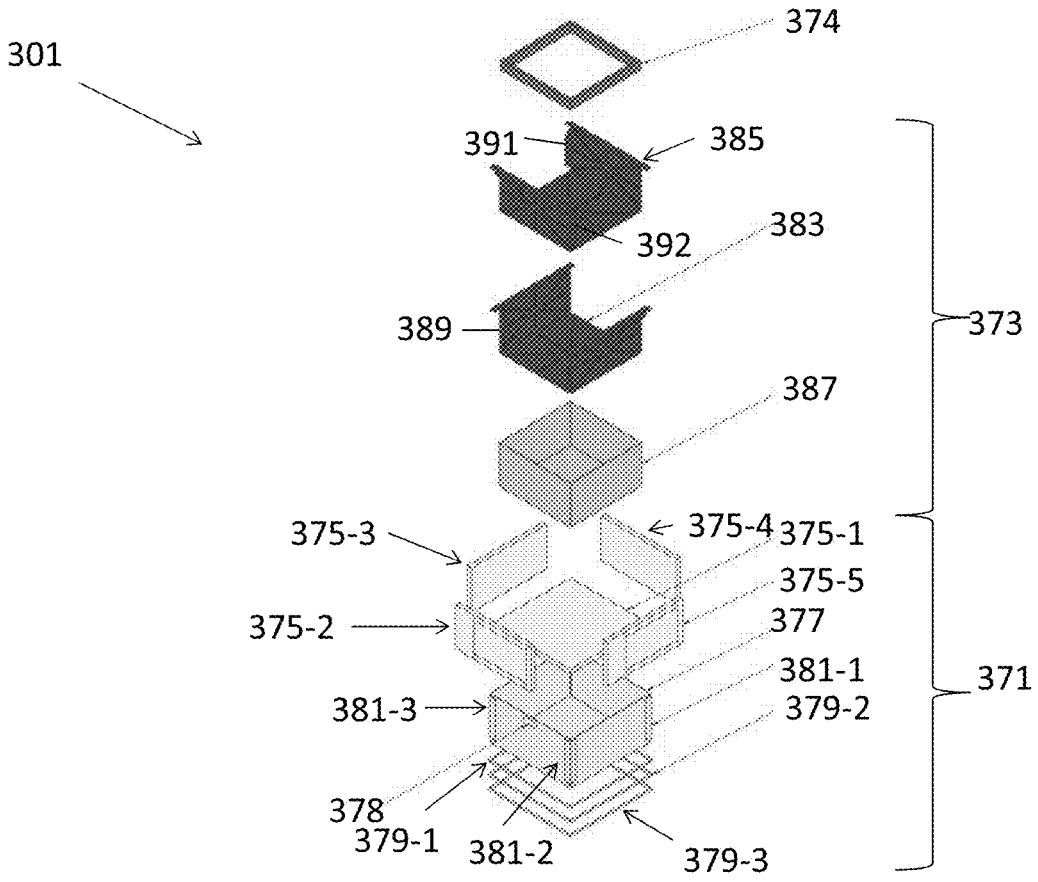
FIG. 8 is a partly exploded perspective view of the shipping system of FIG. 7, with certain components of the shipping system not being shown to reveal other components.

Referring now to FIGS. 7 and 8, there are shown views of a third embodiment of a shipping system suitable for use in storing and/or transporting temperature-sensitive materials, the shipping system being constructed according to the present invention and being represented generally by reference numeral 301. For clarity and/or ease of illustration, certain details of shipping system 301 that are discussed elsewhere in this application or that are not critical to an understanding of the invention may be omitted from one or more of FIGS. 7 and 8 or may be shown therein in a simplified manner.

System 301 may be similar in many respects to system 251, the principal differences between the two systems being that system 301 may be designed for a product box 303 having a comparatively larger volume, such as 30 L, whereas system 251 may be designed for a product box 255 having a comparatively smaller volume, such as 15 L. Accordingly, many of the components of system 301, such as outer box 305 and protective container 307 (with a label 308), may be dimensioned to reflect the aforementioned larger payload volume. In addition, also due to its comparatively larger payload volume, system 301 may comprise eight temperature-control members 309-1 through 309-8, as compared to the five temperature-control members 257-1 through 257-5 of system 251.

One or more handles 331 may be secured to outer box 305.

As seen best in FIG. 8, some additional components that may be disposed within outer box 305 may include an insulation unit 371, a liner assembly 373, and a riser 374.

Insulation unit 371 may be similar in construction and function to insulation unit 51, the only difference between insulation unit 371 and insulation unit 51 being in the respective sizes of some of the components thereof. Accordingly, insulation unit 371 may comprise a plurality of vacuum insulated panels 375-1 through 375-5, a support 377 (shown with a label 378), a plurality of binding straps 379-1 through 379-3, and four corner boards 381-1 through 381-4 (corner board 381-4 not being shown).

Liner assembly 373, which may be similar to liner assembly 81 of system 11, may comprise a first liner piece 383, a second liner piece 385, and a liner support 387. First liner piece 383 and second liner piece 385 may be similar in most respects to first liner piece 83 and second liner piece 85, respectively, of liner assembly 81, the principal differences between the respective liner pieces being (1) that first liner piece 383 and second liner piece 385 are differently dimensioned than first liner piece 83 and second liner piece 85, respectively, (2) that first liner piece 383 is shaped to additionally include a pair of tabs 389 that are positioned diametrically opposed to one another (only one such tab 389 being visible), and (3) that second liner piece 385 is shaped to additionally include a pair of tabs 391 and 392 that are positioned diametrically opposed to one another. Tabs 389, 391 and 392 may be used to delimit sliding movement of first liner piece 383 and second liner piece 385 relative to one another.

Liner support 387 may be similar to liner support 87, the principal difference between the two liner supports being that they are differently dimensioned.

Riser 374 may be similar to riser 141, the principal difference between the two risers being that they are differently dimensioned.

Figure 9:
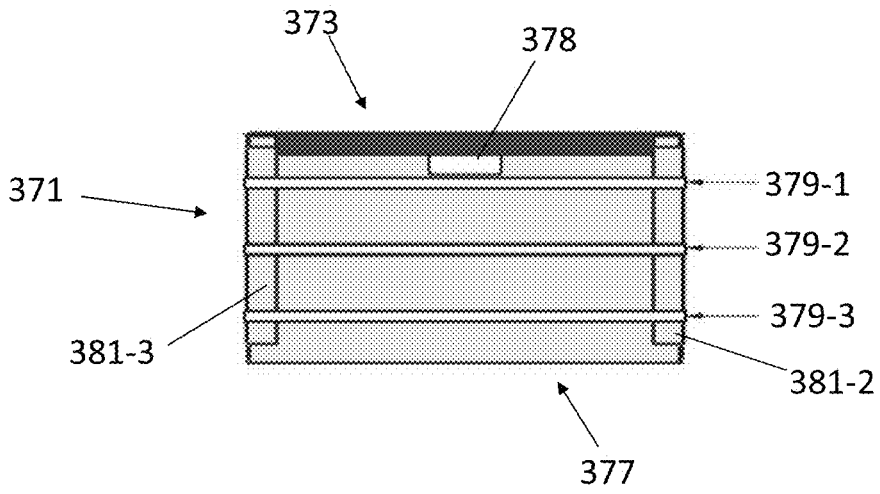
FIG. 9 is a side view, showing the insulation unit and the liner assembly of FIG. 8 in assembled form.

Referring now to FIG. 9, there is shown the assembled combination of insulation unit 371 and liner assembly 373.

Figure 10:
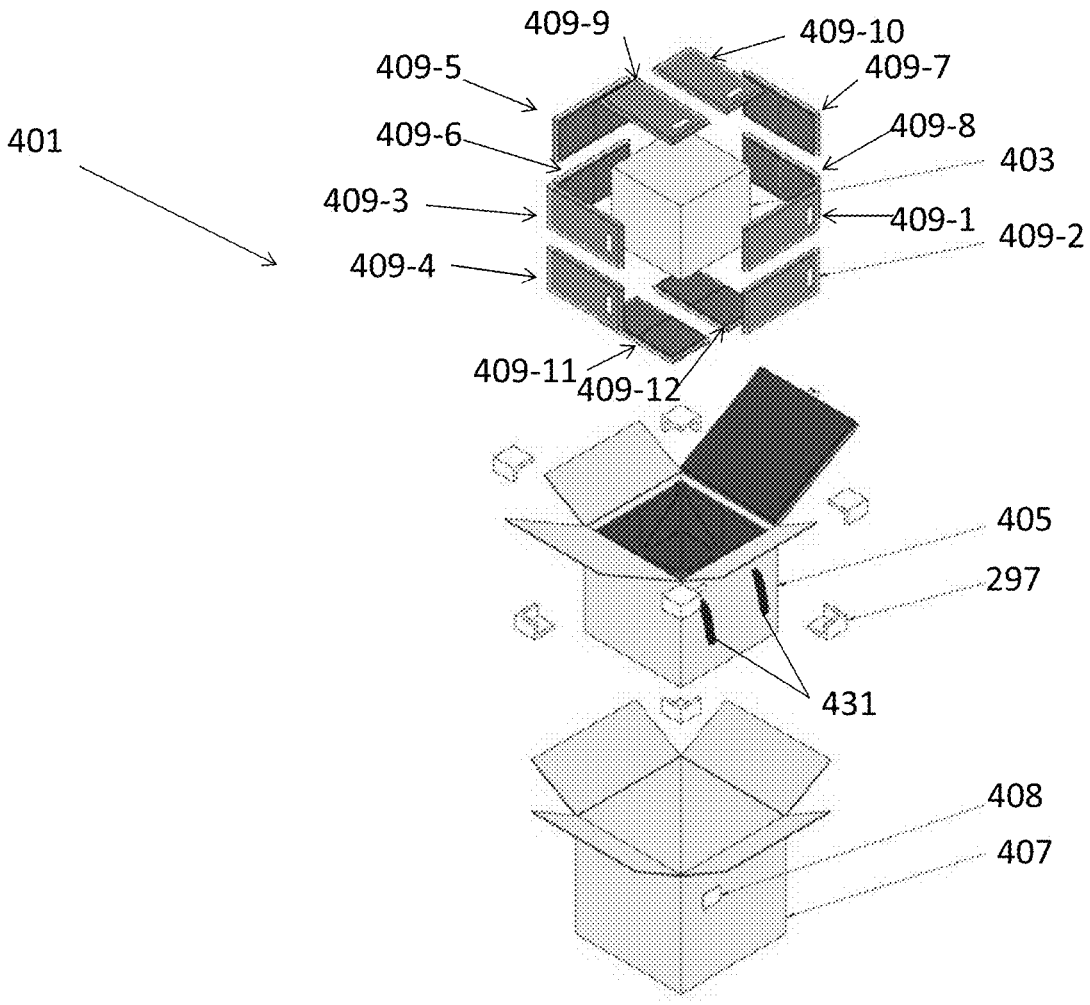
FIG. 10 is a partly exploded perspective view of a fourth embodiment of a shipping system suitable for use in storing and/or transporting temperature-sensitive materials, the shipping system being constructed according to the teachings of the present invention.
Figure 11:
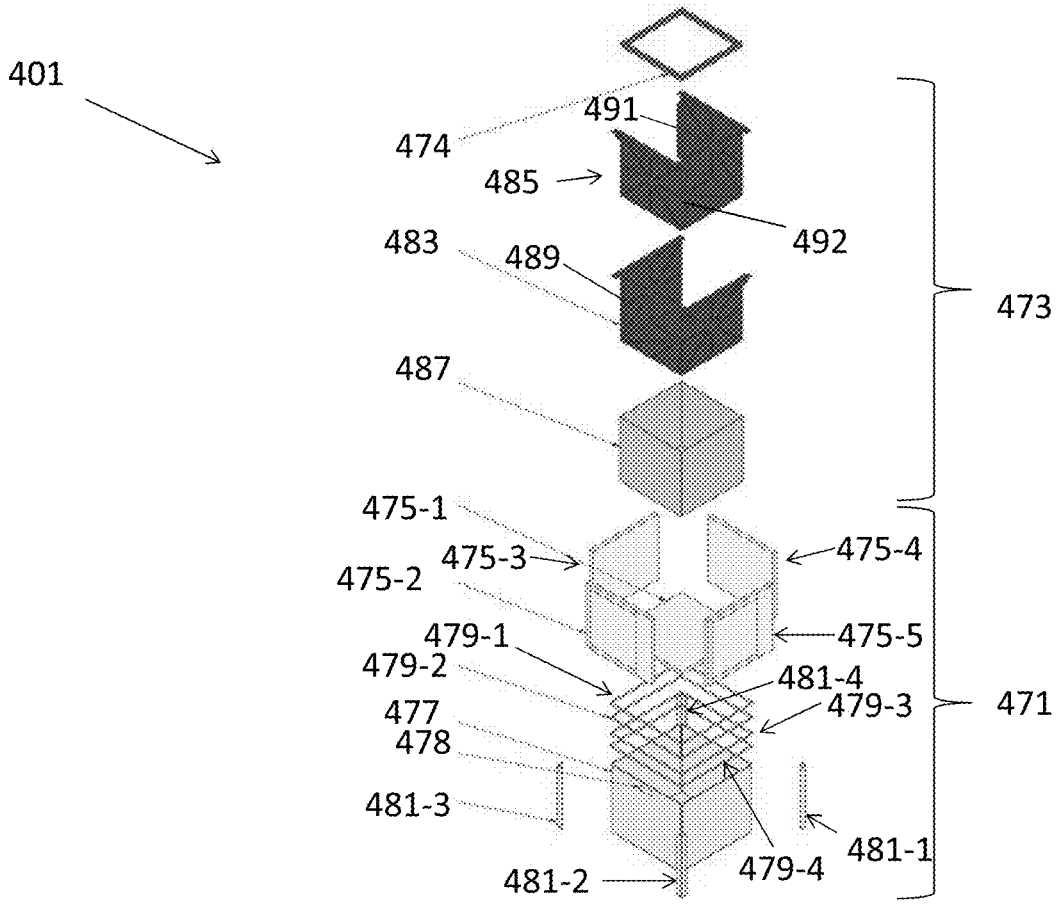
FIG. 11 is a partly exploded perspective view of the shipping system of FIG. 10, with certain components of the shipping system not being shown to reveal other components.

Referring now to FIGS. 10 and 11, there are shown views of a fourth embodiment of a shipping system suitable for use in storing and/or transporting temperature-sensitive materials, the shipping system being constructed according to the present invention and being represented generally by reference numeral 401. For clarity and/or ease of illustration, certain details of shipping system 401 that are discussed elsewhere in this application or that are not critical to an understanding of the invention may be omitted from one or more of FIGS. 10 and 11 or may be shown therein in a simplified manner.

System 401 may be similar in many respects to system 251, the principal differences between the two systems being that system 401 may be designed for a product box 403 having a comparatively larger volume, such as 59 L, whereas system 251 may be designed for a product box 255 having a comparatively smaller volume, such as 15 L. Accordingly, many of the components of system 401, such as outer box 405 and protective container 407 (with a label 408), may be dimensioned to reflect the aforementioned larger payload volume. In addition, also due to its comparatively larger payload volume, system 401 may comprise twelve temperature-control members 409-1 through 409-12, as compared to the five temperature-control members 257-1 through 257-5 of system 251.

One or more handles 431 may be secured to outer box 405.

As seen best in FIG. 11, some additional components that may be disposed within outer box 405 may include an insulation unit 471, a liner assembly 473, and a riser 474.

Insulation unit 471 may be similar in construction and function to insulation unit 51, the only differences between insulation unit 471 and insulation unit 51 being in the respective sizes of some of the components thereof and in the number of binding straps present. Accordingly, insulation unit 471 may comprise a plurality of vacuum insulated panels 475-1 through 475-5, a support 477 (shown with a label 478), a plurality of binding straps 479-1 through 479-4, and four corner boards 481-1 through 481-4.

Liner assembly 473, which may be similar to liner assembly 81 of system 11, may comprise a first liner piece 483, a second liner piece 485, and a liner support 487. First liner piece 483 and second liner piece 485 may be similar in most respects to first liner piece 83 and second liner piece 85, respectively, of liner assembly 81, the principal differences between the respective liner pieces being (1) that first liner piece 483 and second liner piece 485 are differently dimensioned than first liner piece 83 and second liner piece 85, respectively, (2) that first liner piece 483 is shaped to additionally include a pair of tabs 489 that are positioned diametrically opposed to one another (only one such tab 489 being visible in FIG. 11), and (3) that second liner piece 485 is shaped to additionally include tabs 491 and 492. Tabs 489, 491 and 492 may be used to delimit sliding movement of first liner piece 483 and second liner piece 485 relative to one another.

Liner support 487 may be similar to liner support 87, the principal difference between the two liner supports being that they are differently dimensioned.

Riser 474 may be similar to riser 141, the principal difference between the two risers being that they are differently dimensioned.

Figure 12:
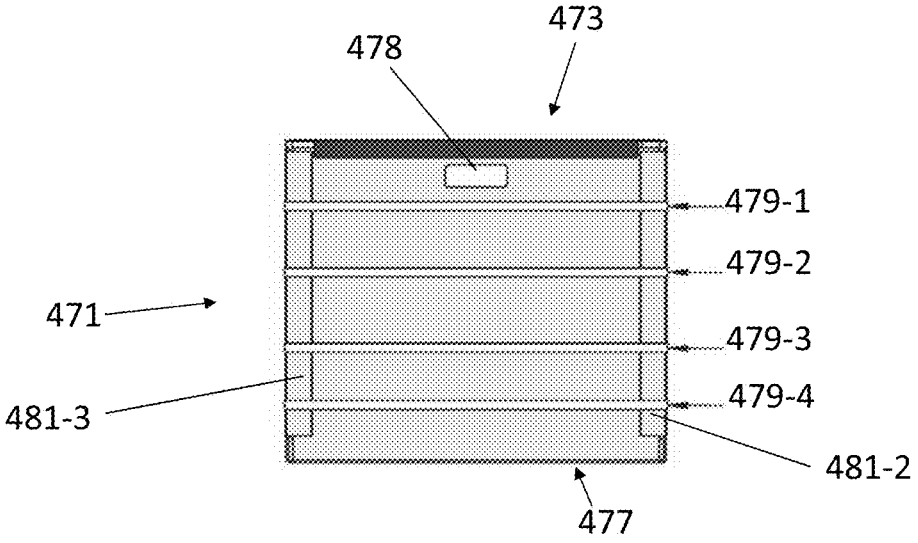
FIG. 12 is a side view, showing the insulation unit and the liner assembly of FIG. 11 in assembled form.

Referring now to FIG. 12, there is shown the assembled combination of insulation unit 471 and liner assembly 473.

It may be noted that system 11, system 251, system 301, and system 401 all may use the same type of temperature-control member. This may be advantageous in that the number of components needed for the entire line of systems may be reduced.

Figure 13:
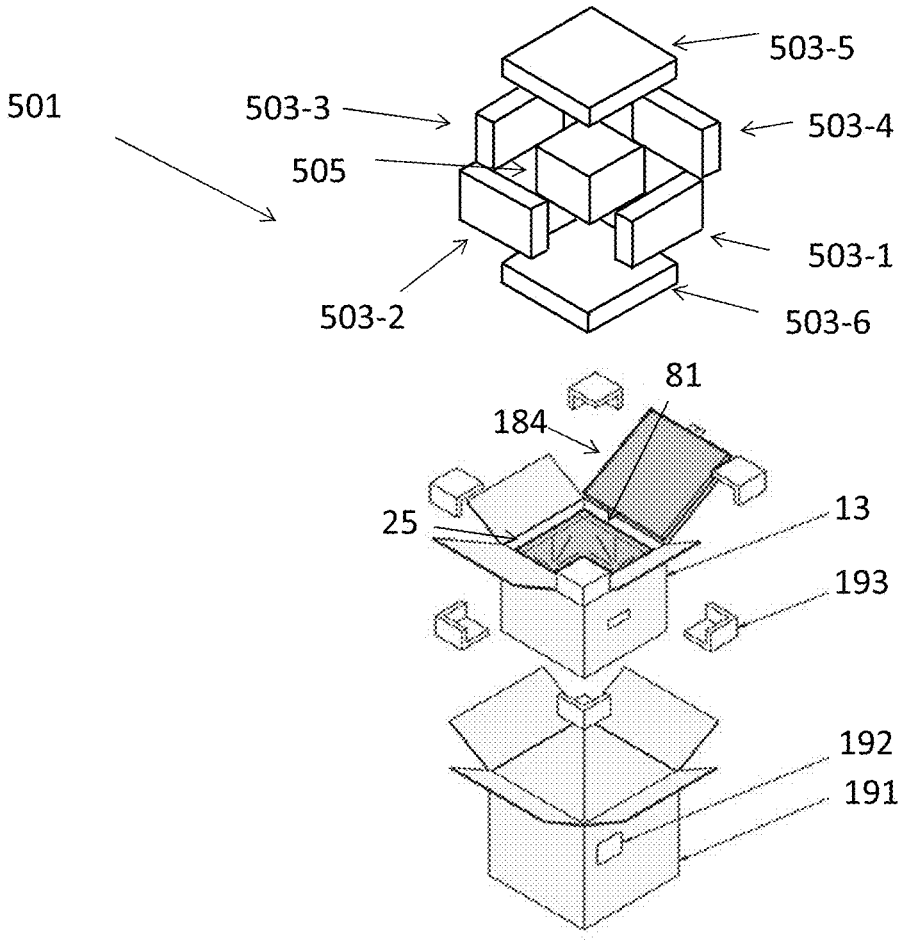
FIG. 13 is a partly exploded perspective view of a fifth embodiment of a shipping system suitable for use in storing and/or transporting temperature-sensitive materials, the shipping system being constructed according to the teachings of the present invention.

Referring now to FIG. 13, there is shown a partly exploded perspective view of a fifth embodiment of a shipping system suitable for use in storing and/or transporting temperature-sensitive materials, the shipping system being constructed according to the present invention and being represented generally by reference numeral 501. For clarity and/or ease of illustration, certain details of shipping system 501 that are discussed elsewhere in this application or that are not critical to an understanding of the invention may be omitted from FIG. 13 or may be shown therein in a simplified manner.

System 501 may be similar in many respects to system 11, the principal difference between the two systems being that, whereas system 11 may comprise temperature-control members 106-1 through 106-3, system 501 may instead comprise lateral temperature-control members 503-1 through 503-4, an upper temperature-control member 503-5, and a lower temperature-control member 503-6. Each of temperature-control members 503-1 through 503-6 may comprise a container, which container may be made of corrugated cardboard or a similar material, and may also comprise a quantity of dry ice, which may be in pellet form, the dry ice being disposed within the container. If desired, the quantity of dry ice in the container may be at least enough to ensure that, at least initially, the entire inner surface of the container facing the payload is covered with dry ice.

In the present embodiment, system 501 may comprise a product box 505 that may be generally rectangular and may be, for example, a cube. Temperature-control members 503-1 through 503-4 may be dimensioned so that the front surface, the rear surface, the left side surface, and the right side surface of a product box 505 may be completely covered by and directly contacted with temperature-control members 503-1 through 503-4, respectively. In addition, temperature-control member 503-5 may be dimensioned to completely cover and directly contact the top surface of product box 505, and temperature-control member 503-6 may be dimensioned to completely cover and directly contact the bottom surface of product box 505.

Figure 14A:
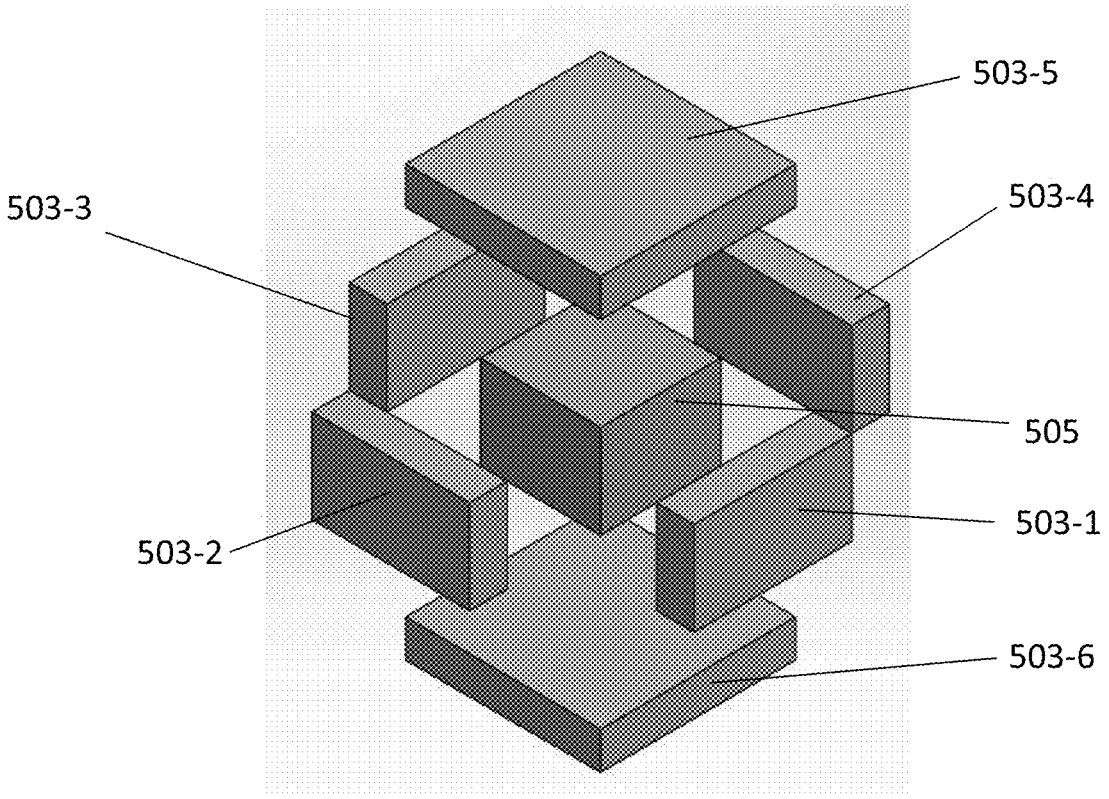
FIGS. 14(*a*) and 14(*b*) are partly exploded and perspective views, respectively, of the product box and the temperature-control members of the system of FIG. 13.
Figure 14B:
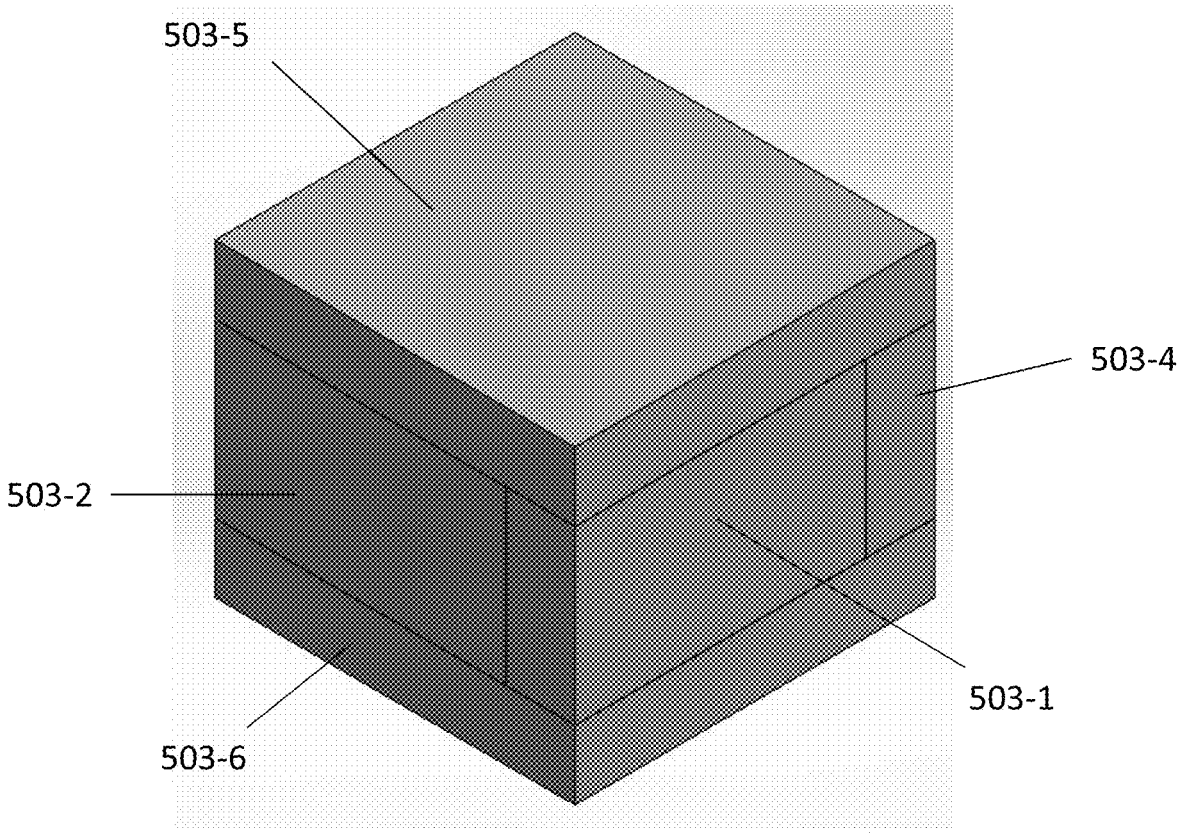

Referring now to FIGS. 14(*a*) and 14(*b*), product box 505 and temperature-control members 503-1 through 503-6 are shown separately from the other components of system 501 in exploded and assembled states, respectively. As can be seen, each of temperature-control members 503-1 through 503-6 is structurally separable and distinct from one another and comprises its own closed, six-sided container.

One advantageous feature of system 501 is that, as compared to conventional shipping systems that utilize loose dry ice as a phase-change material to keep a payload within a desired temperature range, system 501 keeps its dry ice substantially localized on the various surfaces of product box 505 by incorporating its dry ice into temperature-control members 503-1 through 503-6. As a result, during use, system 501 is able to keep some dry ice on each face of product box 505 until such dry ice has melted. By contrast, conventional shipping systems using loose dry ice are apt to have the loose dry ice shift within the shipping container during shipment, often resulting in the top surface of the product box becoming devoid of any dry ice as such dry ice tends to slide off the top surface of the product box during shipping.

As can be appreciated, the dimensions of product box 505 and temperature-control members 503-1 through 503-6 may be varied.

Figure 15A:
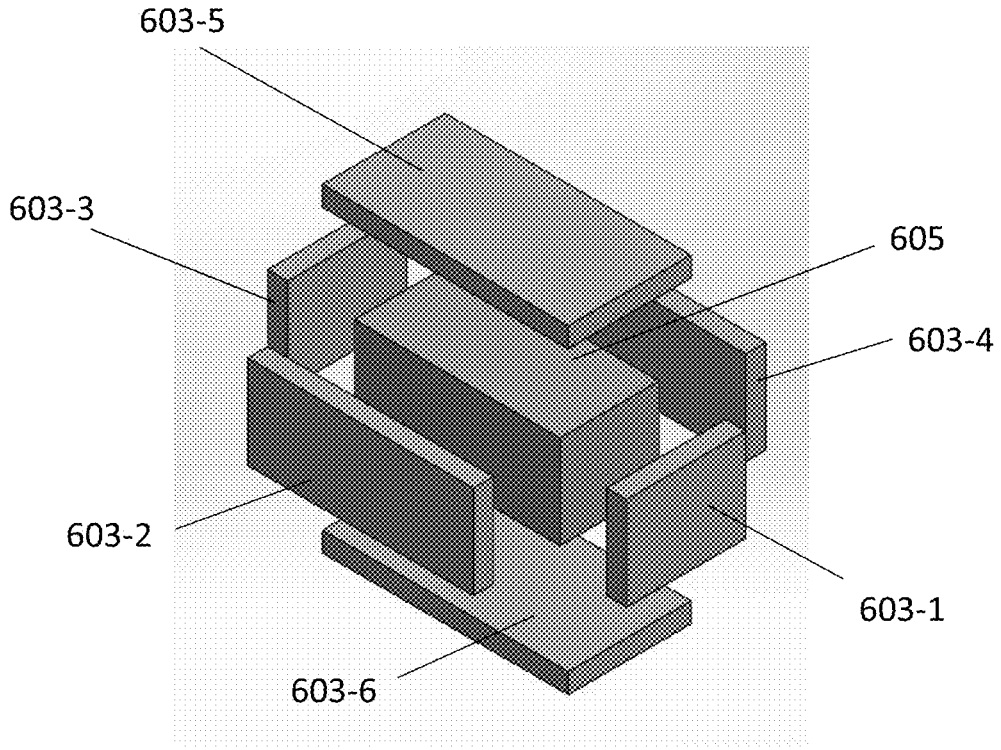
FIGS. 15(*a*) and 15(*b*) are partly exploded and perspective views, respectively, of a first alternative embodiment to the product box and temperature-control members shown in FIGS. 14(*a*) and 14(*b*)
Figure 15B:
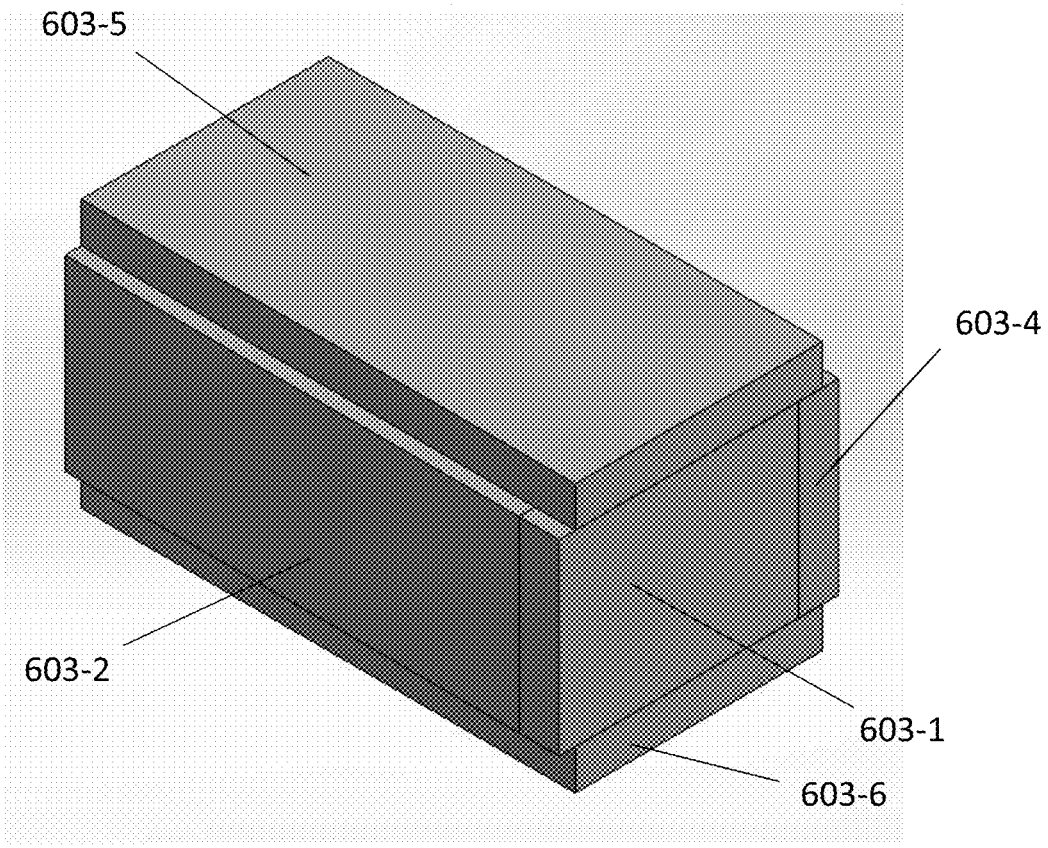

For example, in FIGS. 15(*a*) and 15(*b*), there is shown a collection of temperature-control members 603-1 through 603-6 and a product box 605 in exploded and assembled states, respectively. Product box 605 may be of greater size than product box 505, and temperature-control members 603-1 through 603-6 may be dimensioned correspondingly for use with product box 605. The remaining components of a system for use with the above would likely need to be modified dimensionally (e.g., enlarged) to accommodate the foregoing.

Figure 16A:
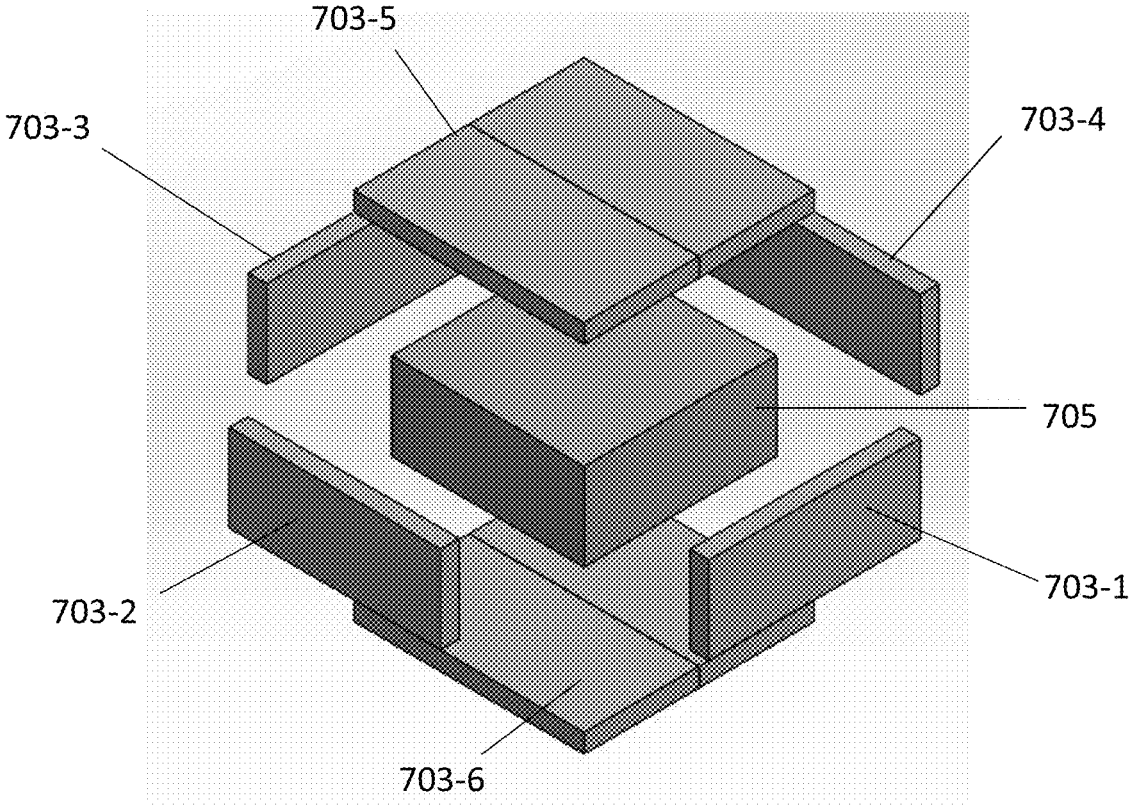
FIGS. 16(*a*) and 16(*b*) are partly exploded and perspective views, respectively, of a second alternative embodiment to the product box and temperature-control members shown in FIGS. 14(*a*) and 14(*b*)
Figure 16B:
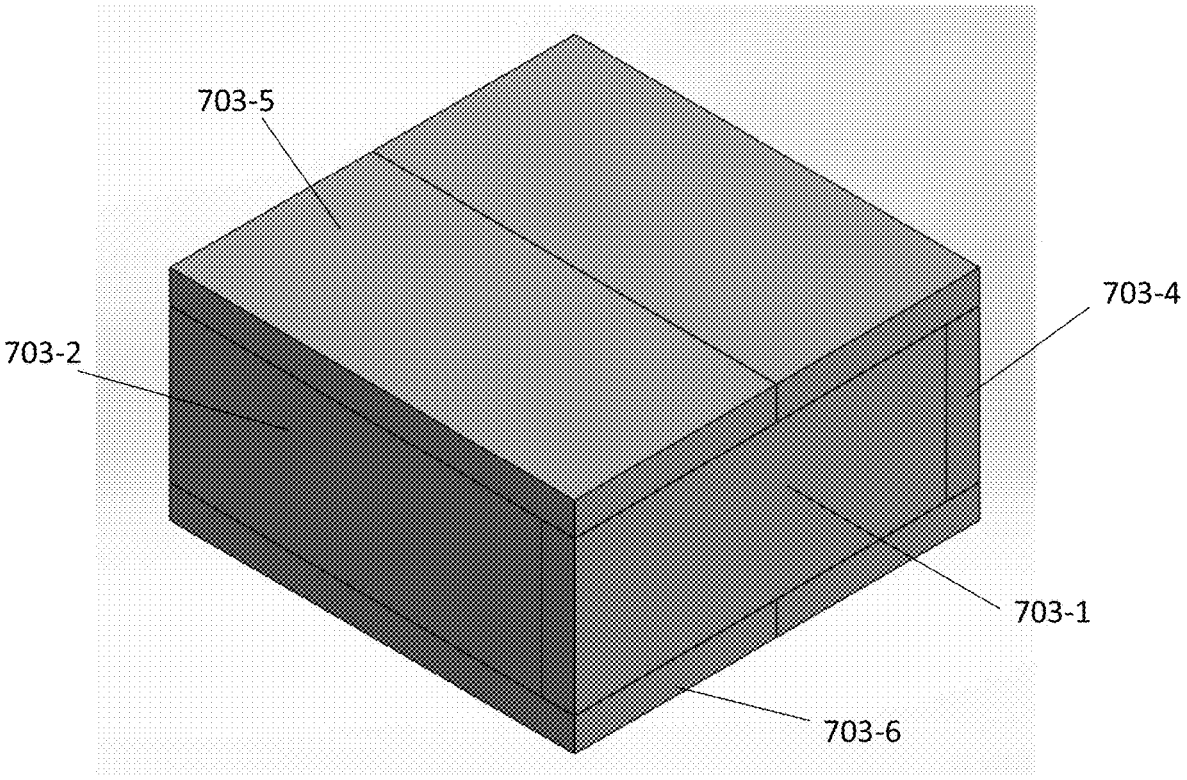

As another example, in FIGS. 16(*a*) and 16(*b*), there is shown a collection of temperature-control members 703-1 through 703-6 and a product box 705 in exploded and assembled states, respectively. Product box 705 may be of even greater size than product box 605, and temperature-control members 703-1 through 703-6 may be dimensioned correspondingly for use with product box 705. (Each of temperature-control members 703-5 and 703-6 may comprise two separable or divided portions.) The remaining components of a system for use with the above would likely need to be modified dimensionally (e.g., enlarged) to accommodate the foregoing.

Figure 17A:
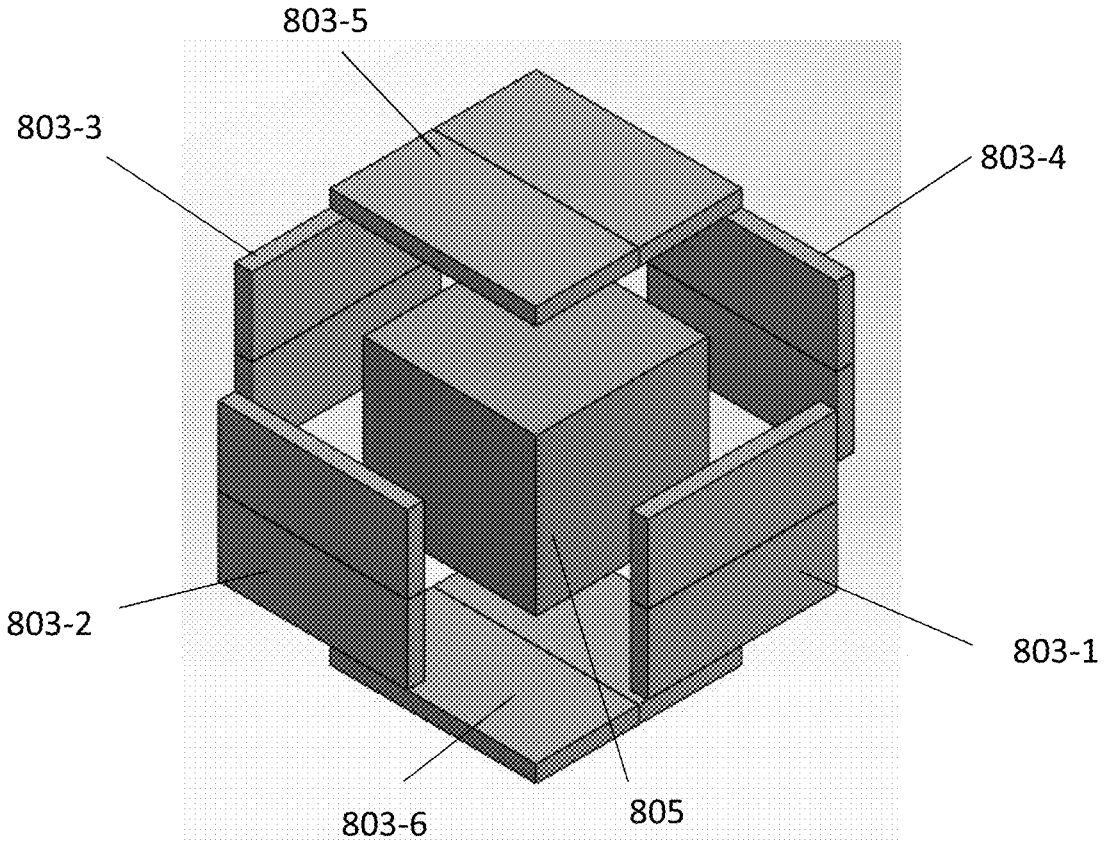
FIGS. 17(*a*) and 17(*b*) are partly exploded and perspective views, respectively, of a third alternative embodiment to the product box and temperature-control members shown in FIGS. 14(*a*) and 14(*b*)
Figure 17B:
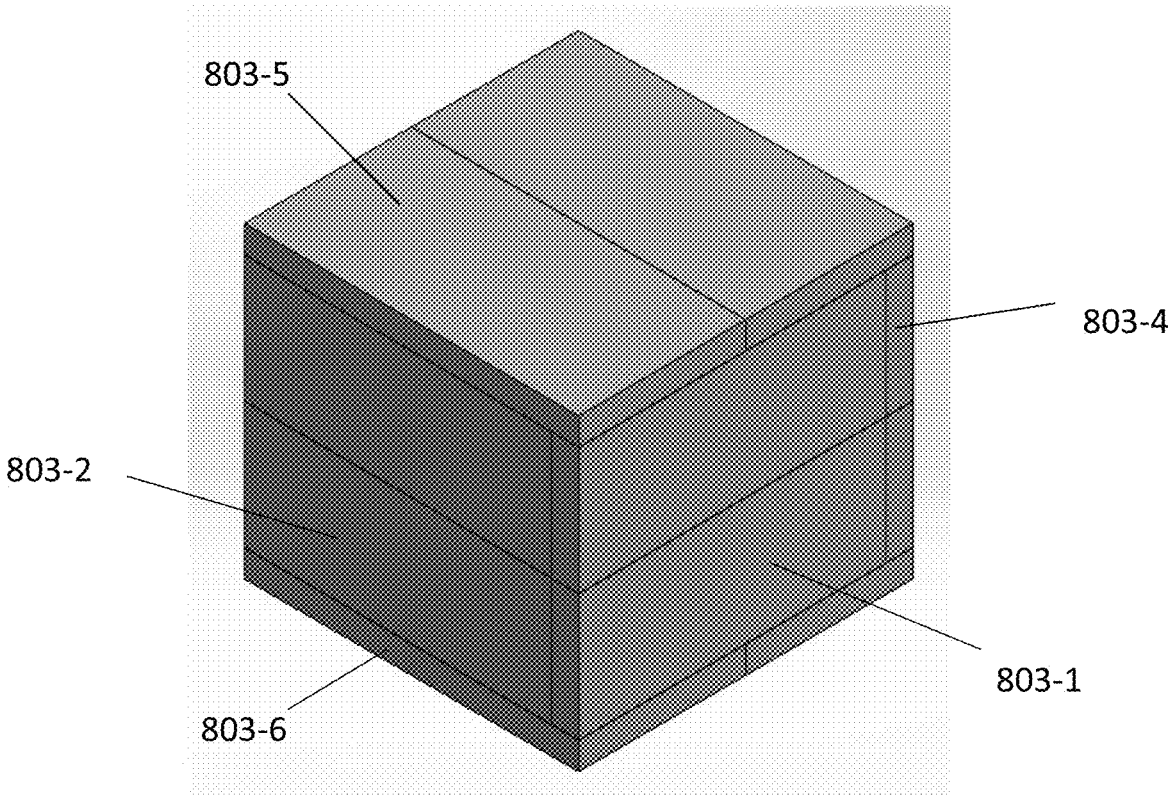

As still another example, in FIGS. 17(*a*) and 17(*b*), there is shown a collection of temperature-control members 803-1 through 803-6 and a product box 805 in exploded and assembled states, respectively. Product box 805 may be of even greater size than product box 705, and temperature-control members 803-1 through 803-6 may be dimensioned correspondingly for use with product box 805. (Each of temperature-control members 803-1 through 803-6 may comprise two separable or divided portions.) The remaining components of a system for use with the above would likely need to be modified dimensionally (e.g., enlarged) to accommodate the foregoing.

In any of the embodiments of FIGS. 14(*a*)-14(*b*) through 17(*a*)-17(*b*), a temperature-control member may comprise one or more dividers to divide the volume for dry ice into a plurality of compartments.

In at least some of the foregoing embodiments, at least some of the temperature-control members may be alternatively usable in two or more of the embodiments. As a result, the number of different types of temperature-control members usable across the entire line of embodiments may be reduced.

In other embodiments, the containers for the lateral temperature-control members discussed above may be replaced with a scaffolding structure (which may be made of cardboard or a similar material) defining a central cavity, in which the product box may be snugly received, and a plurality of peripheral cavities (e.g., one or more front, one or more rear, one or more left side, and/or one or more right side cavities), which may cover one or more of the front, rear, and side faces of the product box, and which may contain dry ice pellets. The tops and bottoms of the aforementioned peripheral cavities may be closed by upper and lower temperature-control members, and the outer sides of the peripheral cavities may be closed by the liner assembly.

Figure 18A:
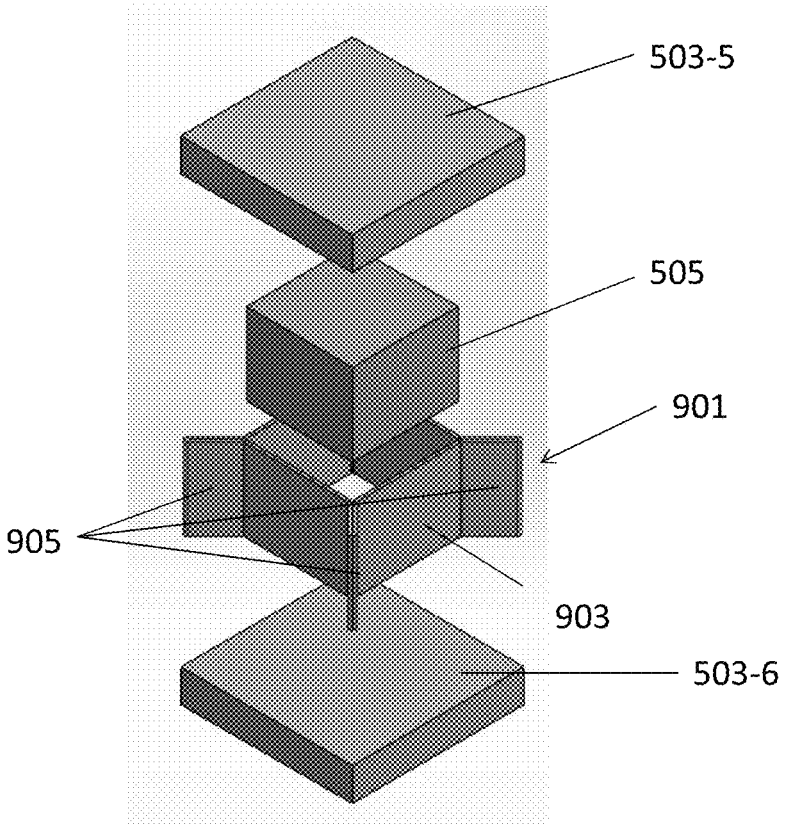
FIGS. 18(*a*) and 18(*b*) are partly exploded and perspective views, respectively, of a fourth alternative embodiment to the product box and temperature-control members shown in FIGS. 14(*a*) and 14(*b*)
Figure 18B:
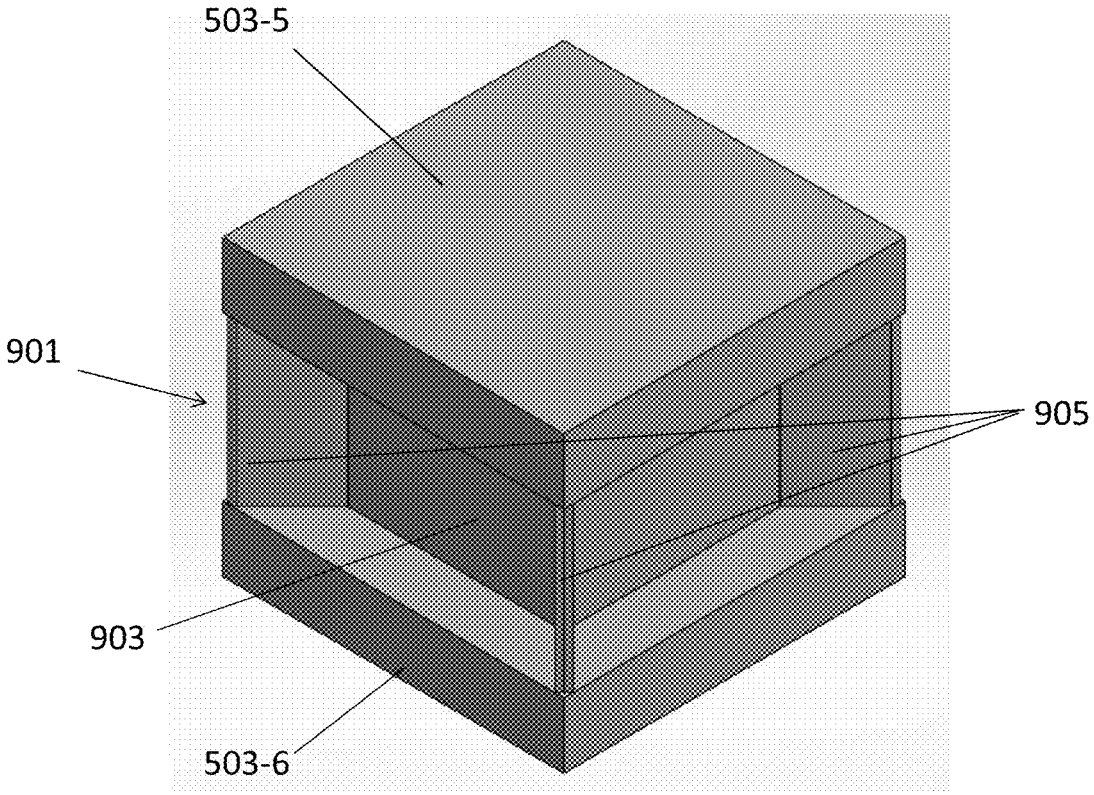

For example, referring now to FIGS. 18(*a*) and 18(*b*), product box 505 and temperature-control members 503-5 and 503-6 of system 501 are shown in exploded and assembled states, respectively, in combination with a scaffolding structure 901, scaffolding structure 901 replacing the containers used to form temperature-control members 503-1 through 503-4 of system 501. In the present embodiment, scaffolding structure 901 may be shaped to define a generally square frame 903, which may be dimensioned to snugly receive product box 505, and a plurality of baffles 905 extending outwardly from the corners of frame 903.

Figure 19A:
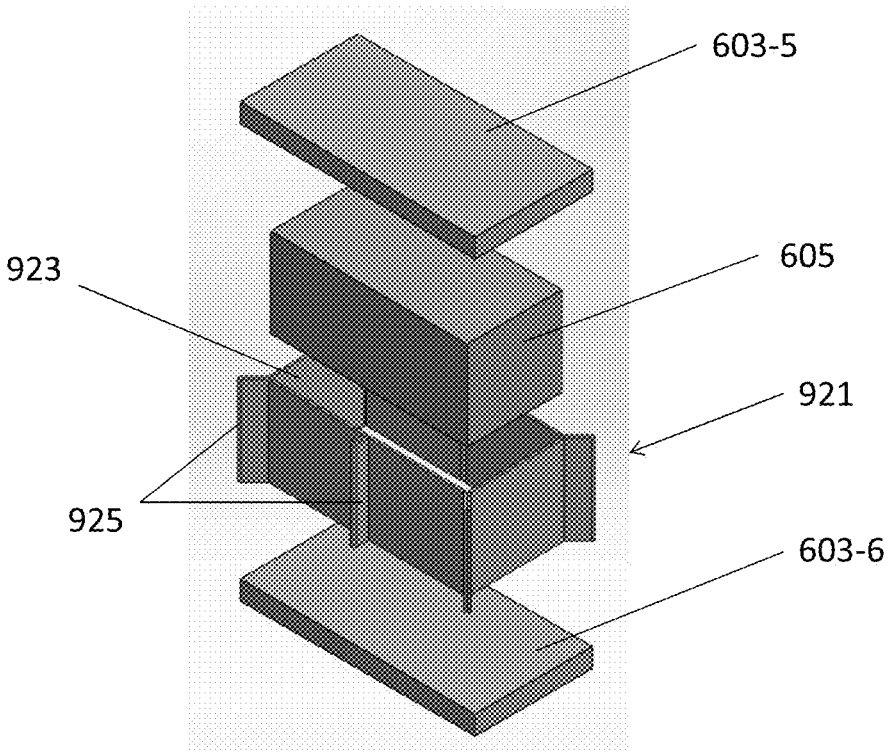
FIGS. 19(*a*) and 19(*b*) are partly exploded and perspective views, respectively, of a fifth alternative embodiment to the product box and temperature-control members shown in FIGS. 14(*a*) and 14(*b*)
Figure 19B:
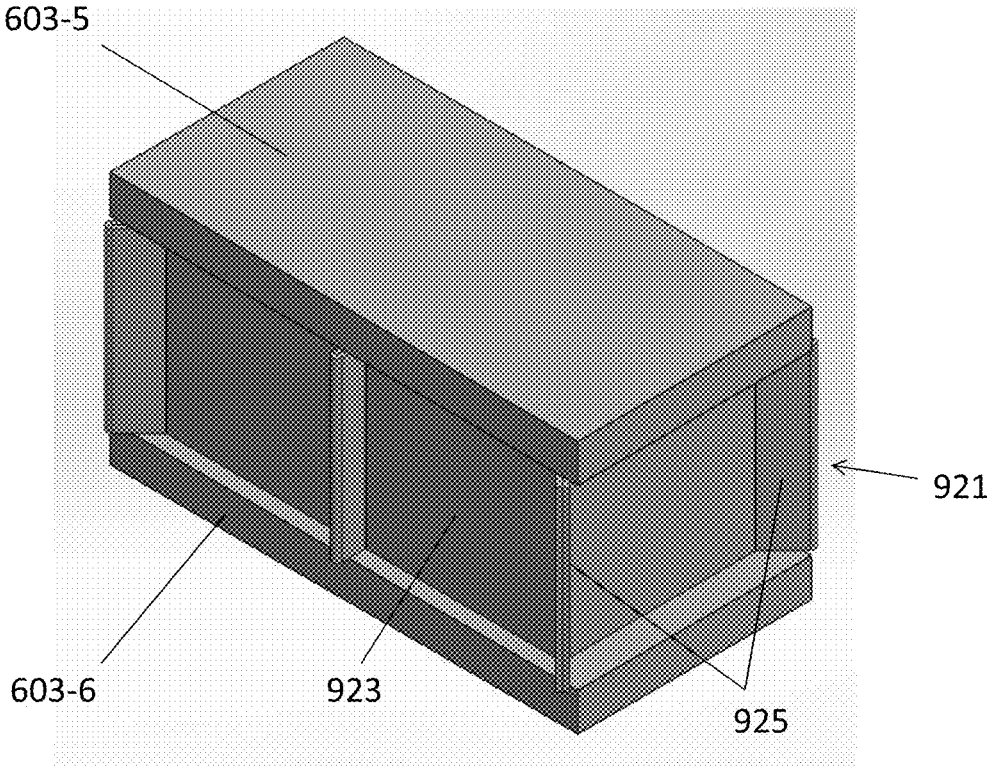

As another example, referring now to FIGS. 19(*a*) and 19(*b*), product box 605 and temperature-control members 603-5 and 603-6 are shown in exploded and assembled states, respectively, in combination with a scaffolding structure 921, scaffolding structure 921 replacing the containers used to form temperature-control members 603-1 through 603-4. In the present embodiment, scaffolding structure 921 may be shaped to define a generally rectangular frame 923, which may be dimensioned to snugly receive product box 605, and a plurality of baffles 925 extending outwardly from the corners of frame 923, as well as from the middle of the long sides of frame 923.

Figure 20A:
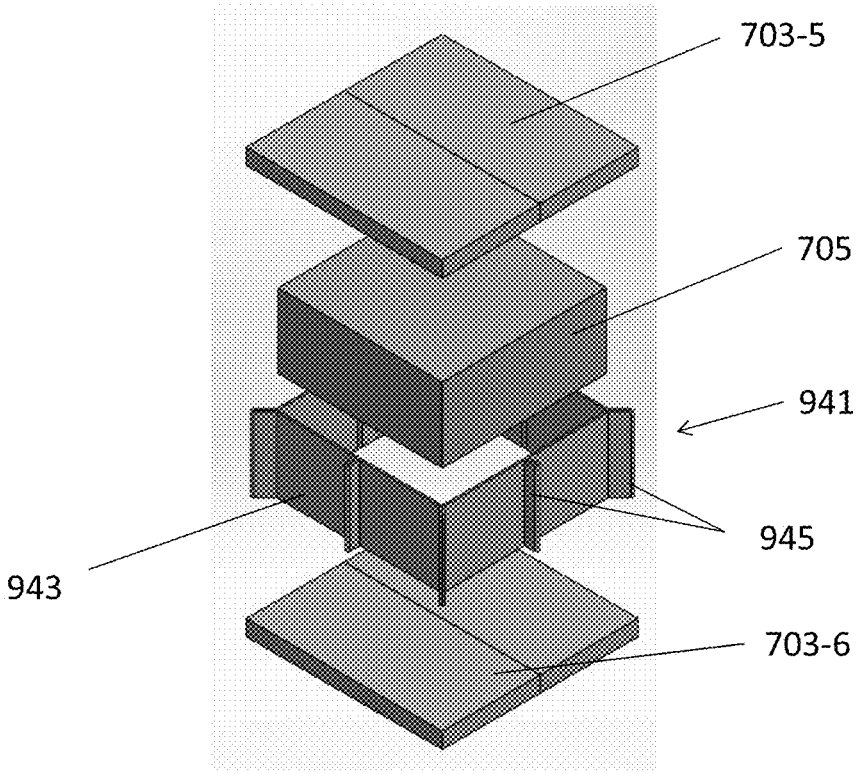
FIGS. 20(*a*) and 20(*b*) are partly exploded and perspective views, respectively, of a sixth alternative embodiment to the product box and temperature-control members shown in FIGS. 14(*a*) and 14(*b*)
Figure 20B:
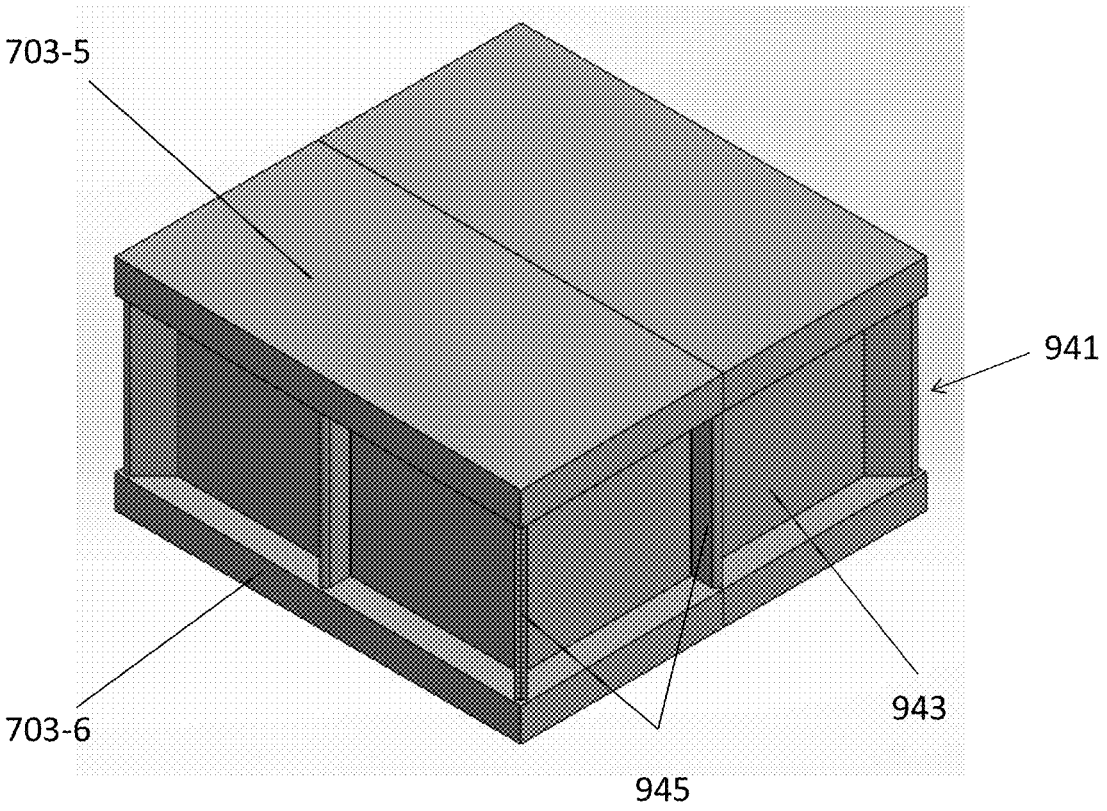

As another example, referring now to FIGS. 20(*a*) and 20(*b*), product box 705 and temperature-control members 703-5 and 703-6 are shown in exploded and assembled states, respectively, in combination with a scaffolding structure 941, scaffolding structure 941 replacing the containers used to form temperature-control members 703-1 through 703-4. In the present embodiment, scaffolding structure 941 may be shaped to define a generally square frame 943, which may be dimensioned to snugly receive product box 705, and a plurality of baffles 945 extending outwardly from the corners of frame 943, as well as from the middle of each side of frame 943.

Figure 21A:
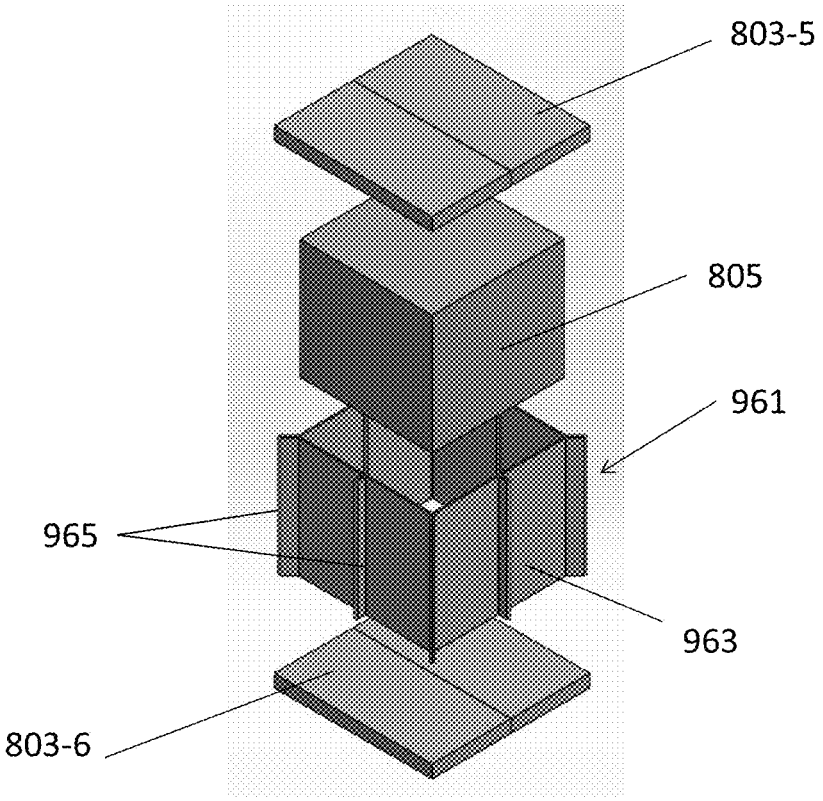
FIGS. 21(*a*) and 21(*b*) are partly exploded and perspective views, respectively, of a seventh alternative embodiment to the product box and temperature-control members shown in FIGS. 14(*a*) and 14(*b*).
Figure 21B:
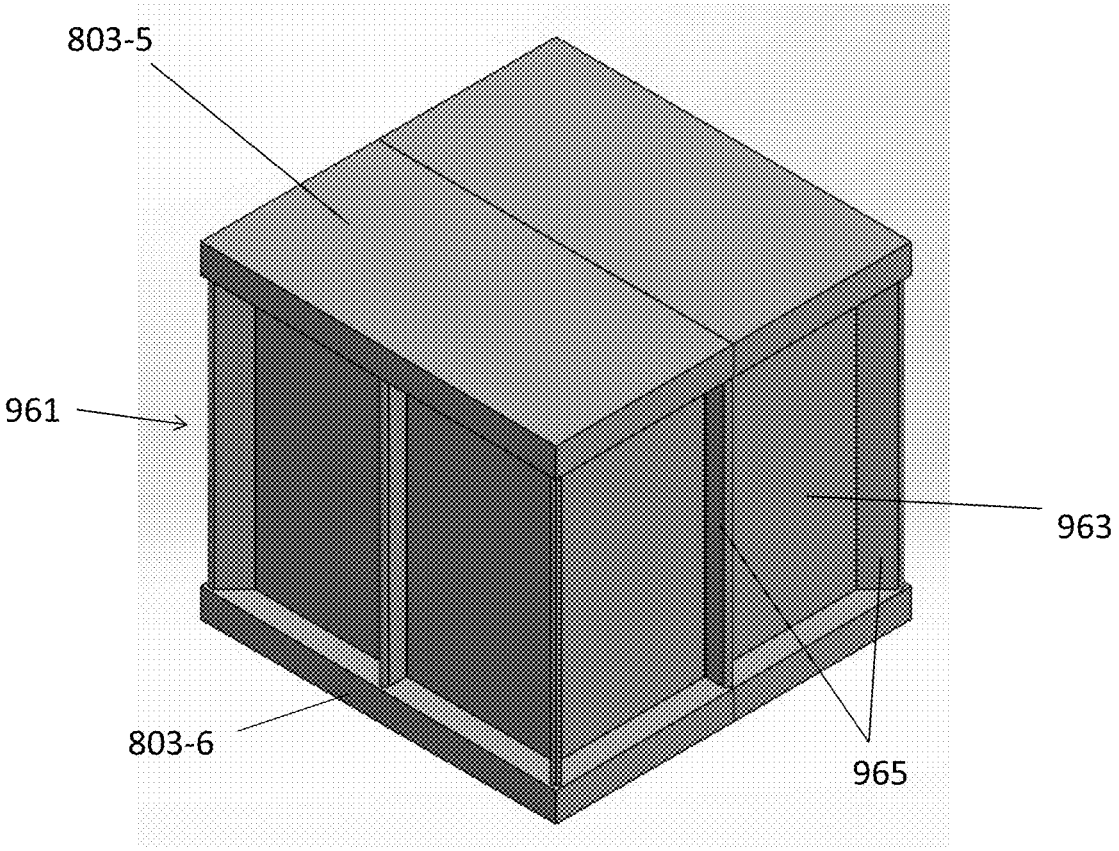

As yet another example, referring now to FIGS. 21(*a*) and 21(*b*), product box 805 and temperature-control members 803-5 and 803-6 are shown in exploded and assembled states, respectively, in combination with a scaffolding structure 961, scaffolding structure 961 replacing the containers used to form temperature-control members 803-1 through 803-4. In the present embodiment, scaffolding structure 961 may be shaped to define a generally square frame 963, which may be dimensioned to snugly receive product box 805, and a plurality of baffles 965 extending outwardly from the corners of frame 963, as well as from the middle of each side of frame 963.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A shipping system for use in transporting and/or storing temperature-sensitive materials, the shipping system comprising:

(a) an outer box, the outer box comprising a cavity;

(b) an insulation unit, the insulation unit disposed within the cavity of the outer box;

(c) a liner assembly, the liner assembly removably mounted on or in the insulation unit, the liner assembly defining a receptacle having a cavity bounded by a bottom, four sides, and an open top, the liner assembly comprising a first liner piece, wherein the first liner piece comprises a first planar sheet reversibly foldable into a first generally U-shaped structure;

a second liner piece, wherein the second liner piece comprises a second planar sheet foldable into a second generally U-shaped structure, wherein the first and second liner pieces are arranged offset from one another by approximately 90 degrees; and a liner support, wherein the liner support is foldable into a structure having a bottom, four sides, and an open top, and wherein the first liner piece and the second liner piece are arranged on or in the liner support;

(d) a product box, the product box being removably disposed within the cavity of the liner assembly; and (e) at least one temperature-control member, the at least one temperature-control member being disposed within the cavity of the liner assembly.

2. The shipping system as claimed in claim 1 further comprising a riser, the riser being removably disposed within the cavity of the liner assembly, at least some of the at least one temperature-control member being seated on the riser.

3. The shipping system as claimed in claim 2 wherein the riser is a unitary structure shaped to define a rectangular frame having a front, a rear, a left side, a right side, and a central opening.

4. The shipping system as claimed in claim 1 wherein the at least one temperature-control member comprises dry ice.

5. The shipping system as claimed in claim 1 wherein the at least one temperature-control member comprises a flexible mat and wherein the flexible mat comprises exactly two pouches, each pouch containing a quantity of phase-change material, each pouch substantially completely covering a surface of the product box.

6. The shipping system as claimed in claim 1 wherein the outer box comprises a corrugated cardboard box, wherein the corrugated cardboard box comprises a plurality of side walls, a plurality of bottom closure flaps, and a plurality of top closure flaps, and wherein the plurality of side walls, the plurality of bottom closure flaps, and the plurality of top closure flaps collectively bound the cavity of the outer box.

7. The shipping system as claimed in claim 1 wherein the insulation unit comprises a plurality of vacuum insulated panels arranged to define an insulation unit cavity bounded by a bottom wall and four side walls.

8. The shipping system as claimed in claim 7 further comprising an insulated lid, the insulated lid removably mountable over the insulation unit to close the insulation unit cavity.

9. The shipping system as claimed in claim 1 wherein the first liner piece, when folded, comprises a bottom wall extending generally horizontally, a left inner wall extending generally perpendicularly upwardly relative to the bottom wall, and a right inner wall extending generally perpendicularly upwardly relative to the bottom wall, with the left inner wall and the right inner wall extending from opposite ends of the bottom wall.

10. The shipping system as claimed in claim 9 wherein the first liner piece, when folded, further comprises a left top wall extending generally perpendicularly outwardly from the top of the left inner wall, a left outer wall extending generally perpendicularly downwardly for a short distance from an outer edge of the left top wall, a right top wall extending generally perpendicularly outwardly from the top of the right inner wall, and a right outer wall extending generally perpendicularly downwardly for a short distance from an outer edge of the right top wall.

11. The shipping system as claimed in claim 10 wherein the second liner piece, when folded, further comprises a bottom wall extending generally horizontally, a front inner wall extending generally perpendicularly upwardly relative to the bottom wall, and a rear inner wall extending generally perpendicularly upwardly relative to the bottom wall, with the front inner wall and the rear inner wall extending from opposite ends of the bottom wall.

12. The shipping system as claimed in claim 11 wherein the second liner piece, when folded, further comprises a front top wall extending generally perpendicularly outwardly from the top of the front inner wall, a front outer wall extending generally perpendicularly downwardly for a short distance from an outer edge of the front top wall, a rear top wall extending generally perpendicularly outwardly from the top of the rear inner wall, and a rear outer wall extending generally perpendicularly downwardly for a short distance from an outer edge of the rear top wall.

13. The shipping system as claimed in claim 12 wherein the first liner piece is removably inserted into the liner support and, by virtue of being inserted into the liner support, is transformed from a generally planar state to a folded state, with the bottom wall of the first liner piece seated directly on top of the bottom of the liner support, with the left inner wall of the first liner piece positioned against or proximate to a left side of the liner support, with the left top wall of the first liner piece positioned directly over or proximate to a top of the left side of the liner support, with the left outer wall of the first liner piece positioned parallel to and spaced a short distance away from the left side of the liner support, with the right inner wall of the first liner piece positioned against or proximate to a right side of the liner support, with the right top wall of the first liner piece positioned directly over or proximate to a top of the right side of the liner support, and with the right outer wall positioned parallel to and spaced a short distance away from the right side of the liner support.

14. The shipping system as claimed in claim 13 wherein the second liner piece is removably inserted into the liner support and, by virtue of being inserted into the liner support, is transformed from a generally planar state to a folded state, with the bottom wall of the second liner piece seated directly on top of the bottom wall of the first liner piece, with the front inner wall of the second liner piece positioned against or proximate to a front of the liner support, with the front top wall of the second liner piece positioned directly over or proximate to a top of the front of the liner support, with the front outer wall of the second liner piece positioned parallel to and spaced a short distance away from the front of the liner support, with the rear inner wall of the second liner piece positioned against or proximate to a rear of the liner support, with the rear top wall of the second liner piece positioned directly over or proximate to a top of the rear of the liner support, and with the rear outer wall positioned parallel to and spaced a short distance away from the rear of the liner support.

15. The shipping system as claimed in claim 14 wherein the insulation unit has a top and wherein the first liner piece and the second liner piece are dimensioned so that, when the insulation unit and the liner assembly are brought together, the first liner piece and the second liner piece collectively cover the top of the insulation unit.

16. The shipping system as claimed in claim 12 wherein the first liner piece further comprises a tab, wherein the second liner piece further comprises a tab, and wherein the tab of the first liner piece and the tab of the second liner piece are positioned to delimit sliding movement of the first liner piece and the second liner piece relative to one another.

17. The shipping system as claimed in claim 1 wherein each of the first liner piece and the second liner piece is made of a molded polymer.

18. The shipping system as claimed in claim 1 wherein the liner support consists of a single sheet of corrugated cardboard.

19. The shipping system as claimed in claim 1 wherein the at least one temperature-control member comprises exactly five identical flexible mats, wherein each of the exactly five flexible mats comprises exactly two pouches, and wherein each pouch contains a quantity of phase-change material.

20. The shipping system as claimed in claim 19 wherein the product box is generally rectangular and is shaped to include four sides and two ends, wherein each of the four sides is of comparatively greater surface area than each of the two ends, wherein three of the exactly five identical flexible mats completely cover three of the four sides of the product box, and wherein two of the exactly five identical flexible mats collectively cover a fourth side and the two ends of the product box.

21. A kit for assembling a shipping system suitable for use in transporting and/or storing temperature-sensitive materials, the kit comprising:

(a) an insulation unit, the insulation unit shaped to include a cavity bounded by a bottom wall, four side walls, and an open top;

(b) a liner assembly, the liner assembly being removably mounted on or in the insulation unit, the liner assembly being shaped to include a cavity, wherein the cavity of the liner assembly extends into the cavity of the insulation unit, wherein the liner assembly comprises (i) a first liner piece, wherein the first liner piece comprises a sheet foldable into a generally U-shaped structure;

(ii) a second liner piece, wherein the second liner piece comprises a sheet foldable into a generally U-shaped structure, wherein the first and second liner pieces are arranged offset from one another by approximately 90 degrees; and (iii) a liner support, wherein the liner support is foldable into a structure having a bottom, four sides, and an open top, and wherein the first liner piece and the second liner piece are arranged on or in the liner support;

(c) a product box, the product box being removably disposed within the cavity of the liner assembly, the product box being designed to hold a payload;

(d) an insulated lid, the insulated lid covering the cavity of the insulation unit; and (e) a plurality of alternative sets of temperature-control members, each alternative set of temperature-control members being removably disposed within the cavity of the liner assembly and being designed to maintain the payload within a different temperature range.

22. The kit as claimed in claim 21 further comprising a riser, the riser being removably disposed within the cavity of the liner assembly.

23. The kit as claimed in claim 22 wherein the riser comprises a rectangular frame having an opening, wherein the opening is dimensioned to receive the product box, and wherein at least some of the temperature-control members are positionable on the riser.

24. The shipping system as claimed in claim 21 wherein the plurality of alternative sets of temperature-control members comprises a first alternative set of temperature-control members and a second alternative set of temperature-control members, wherein the first alternative set of temperature-control members comprises a first plurality of flexible mats, wherein each flexible mat of the first plurality of flexible mats contains a first phase-change material having a first phase-change temperature, wherein the second alternative set of temperature-control members comprises a second plurality of flexible mats, wherein each flexible mat of the second plurality of flexible mats contains a second phase-change material having a second phase-change temperature, and wherein the second phase-change temperature is different from the first phase-change temperature.

25. A kit for assembling at least one shipping system suitable for use in transporting and/or storing temperature-sensitive materials, the kit comprising:

a first shipper, the first shipper comprising a first insulation unit, the first insulation unit shaped to include a cavity bounded by a bottom wall, a plurality of side walls, and an open top, the plurality of side walls collectively defining a top edge, a first insulated lid, the first insulated lid removably mountable over the first insulation unit to close the cavity of the first insulation unit, a first liner assembly, the first liner assembly being removably mountable on or in the first insulation unit, the first liner assembly being shaped to include a cavity and a flange, wherein the cavity of the first liner assembly is dimensioned to extend into the cavity of the first insulation unit and wherein the flange of the first liner assembly is dimensioned to extend over the top edge of the first insulation unit, a first product box, the first product box being removably positionable within the cavity of the first liner assembly, the first product box being designed to hold a payload;

a second shipper, the second shipper comprising a second insulation unit, the second insulation unit shaped to include a cavity bounded by a bottom wall, a plurality of side walls, and an open top, the plurality of side walls collectively defining a top edge, a second insulated lid, the second insulated lid removably mountable over the second insulation unit to close the cavity of the second insulation unit, a second liner assembly, the second liner assembly being removably mountable on or in the second insulation unit, the second liner assembly being shaped to include a cavity and a flange, wherein the cavity of the second liner assembly is dimensioned to extend into the cavity of the second insulation unit and wherein the flange of the second liner assembly is dimensioned to extend over the top edge of the second insulation unit, a second product box, the second product box being removably positionable within the cavity of the second liner assembly, the second product box being designed to hold a payload, wherein the second product box is dimensioned to hold a differently-sized payload than the first product box;

wherein each of the first and second liner assemblies comprises (i) a first liner piece, wherein the first liner piece comprises a sheet foldable into a generally U-shaped structure; (ii) a second liner piece, wherein the second liner piece comprises a sheet foldable into a generally U-shaped structure, wherein the first and second liner pieces are arranged offset from one another by approximately 90 degrees; and (iii) a liner support, wherein the liner support is foldable into a structure having a bottom, four sides, and an open top, and wherein the first liner piece and the second liner piece are arranged on or in the liner support; and a set of temperature-control members, the set of temperature-control members being dimensioned for alternative deployment in the cavity of the first liner assembly, snugly fitting around the first product box, or the cavity of the second liner assembly, snugly fitting around the second product box.

26. The kit as claimed in claim 25 wherein at least some of the temperature-control members comprise a container and a quantity of dry ice disposed within the container, at least some of the containers being self-contained closed structures that are separable from the other containers.

27. The shipping system as claimed in claim 25 wherein the set of temperature-control members comprises a plurality of flexible mats, wherein each flexible mat comprises a plurality of discrete sealed pouches, and wherein each discrete sealed pouch contains a quantity of a phase-change material.

28. A method comprising:

providing a shipping system for use in transporting and/or storing temperature-sensitive materials, the shipping system comprising:

an outer box, the outer box comprising a cavity, an insulation unit, the insulation unit disposed within the cavity of the outer box, a liner assembly, the liner assembly removably mounted on or in the insulation unit, the liner assembly defining a receptacle having a cavity bounded by a bottom, four sides, and an open top, the liner assembly comprising a first liner piece, wherein the first liner piece comprises a first planar sheet reversibly foldable into a first generally U-shaped structure, a second liner piece, wherein the second liner piece comprises a second planar sheet foldable into a second generally U-shaped structure, wherein the first and second liner pieces are arranged offset from one another by approximately 90 degrees, and a liner support, wherein the liner support is foldable into a structure having a bottom, four sides, and an open top, and wherein the first liner piece and the second liner piece are arranged on or in the liner support, a product box, the product box being removably disposed within the cavity of the liner assembly, and at least one temperature-control member, the at least one temperature-control member being disposed within the cavity of the liner assembly;

using the shipping system to transport a first payload;

then, cleaning or replacing the liner assembly; and then, using the shipping system to transport a second payload.

* * * * *